US006602357B2

(12) United States Patent
Senda et al.

(10) Patent No.: US 6,602,357 B2
(45) Date of Patent: Aug. 5, 2003

(54) GRAIN ORIENTED ELECTRICAL STEEL SHEET WITH LOW IRON LOSS AND PRODUCTION METHOD FOR SAME

(75) Inventors: Kunihiro Senda, Okayama (JP); Toshito Takamiya, Okayama (JP); Tadashi Nakanishi, Okayama (JP); Mitsumasa Kurosawa, Okayama (JP); Hiroaki Toda, Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 10/057,220

(22) Filed: Jan. 24, 2002

(65) Prior Publication Data

US 2002/0157734 A1 Oct. 31, 2002

(30) Foreign Application Priority Data

Jan. 29, 2001 (JP) ..... 2001-019993

(51) Int. Cl.[7] ..... H01F 1/147
(52) U.S. Cl. ..... 148/308
(58) Field of Search ..... 148/308

(56) References Cited

U.S. PATENT DOCUMENTS 6,083,326 A * 7/2000 Komatsubara et al. ..... 148/308
6,103,022 A * 8/2000 Komatsubara et al. ..... 148/308
6,228,182 B1 * 5/2001 Nakano et al. ..... 148/111

FOREIGN PATENT DOCUMENTS

JP 2001-192787 7/2001

* cited by examiner

*Primary Examiner*—John P. Sheehan
(74) *Attorney, Agent, or Firm*—Piper Rudnick LLP

(57) ABSTRACT

A grain oriented electrical steel sheet comprises metal part containing Si: about 2.5 to about 5.0 mass % and Cr: about 0.05 to about 1.0 mass %, and an insulation coating formed on a surface of the metal part. A tension imparted to the metal part in the rolling direction by the insulation coating is not smaller than about 3.0 MPa. Magnetic flux density $B_8$ satisfies a specific relation formula. A plurality of linear strains or grooves are formed in a surface of the steel sheet and linearly extended at an angle of not larger than about 45° (in each direction) relative to a direction perpendicular to a rolling direction such that an interval D of the linear strains or grooves satisfies a specific relation formula depending on the Cr content. A grain oriented electrical steel sheet is thereby obtained which has lower iron loss after domain refining treatment than conventional values. In the production process for the steel sheet of the invention, parameters such as annealing temperature in annealing before final cold rolling are controlled.

13 Claims, 4 Drawing Sheets

CONTAINING Cr

NOT CONTAINING Cr

GRAIN ORIENTED ELECTRICAL STEEL SHEET WITH LOW IRON LOSS AND PRODUCTION METHOD FOR SAME

BACKGROUND OF THE INVENTION

1. Field of the Invention

This invention relates to a grain oriented electrical steel sheet and a production method for the same. More particularly, the invention is intended to obtain a product of a grain oriented electrical steel sheet subjected to domain refining (or subdividing) treatment and having high magnetic flux density, the product having lower iron loss than conventional values.

2. Description of the Related Art

Grain oriented electrical steel sheets are primarily employed as materials for laminated cores and coiled cores of transformers. For the purpose of reducing the power transmission and distribution cost, such a grain oriented electrical steel sheet is required to minimize energy loss caused upon power conversion, called "iron loss."

Iron loss is expressed by the sum of hysteresis loss and eddy current loss. One technique for reducing hysteresis loss is to align a <001> axis of an iron crystal, which is a relatively easily magnetizable axis, with the rolling direction. Thus, it is known that permeability is increased and iron loss is reduced by orienting the crystal structure of iron in a {110}<001> direction, called Goss orientation, at a higher concentration.

Such a crystal structure oriented in the Goss direction at a higher concentration is generally obtained by utilizing a phenomenon called secondary recrystallization. In other words, a desired structure can be produced through preferential growth of crystal grains only in the Goss direction, which is developed by utilizing abnormal grain growth with very high direction selectivity during the thermal growth process of primary recrystallized grains. On that occasion, control of two factors, i.e., direction selectivity and growth rate of abnormal grains, is important in achieving a secondary recrystallized structure oriented in the Goss direction at a higher concentration.

To that end, it is usually pursued to develop a primary recrystallized structure before secondary recrystallization in the form of a particular texture, and to form a precipitate dispersed phase, which is called an inhibitor, in a uniform and appropriate size for selectively inhibiting growth of primary recrystallized grains.

As one technique regarding an inhibitor, Japanese Examined Patent Application Publication No. 46-23820 discloses a technique for forming a composite precipitate phase of MnSe or MnS and AlN to act as a strong inhibitor. It has, however, been confirmed that even when a crystal structure oriented in the Goss direction at a higher concentration is obtained by the disclosed technique, iron loss of a product is not always reduced. The reason is that the sizes of secondary recrystallized grains are increased as the concentration in the Goss direction increases, and at the same time the so-called β angle between the grain direction [001] and the rolled surface comes closer to 0°, whereby the width of a 180°-magnetic domain is widened and eddy current loss is increased.

Various techniques have recently been proposed to reduce the magnetic domain width by an artificial method and to lower the eddy current loss. Those techniques include, for example, methods of irradiating a laser beam (Japanese Examined Patent Application Publication No. 57-2252) and a plasma flame (Japanese Unexamined Patent Application Publication No. 62-96617) in a direction substantially perpendicular to the rolling direction of a steel sheet.

With those proposed methods, the so-called "stress-pattern" magnetic domains, which have a linear or linearly continued shape, are generated in an irradiated area by introducing thermal strains in the surface of a steel sheet. Inside such a magnetic domain, since magnetization occurs in the [100] and [010] directions, the width of a 180°-magnetic domain is reduced due to the effect of magnetostatic energy caused by magnetic poles, which are generated in the boundary between the 180°-magnetic domain in the [100] direction and a stress pattern.

Also, in consideration of the fact that strain removing annealing is essential in coiled cores and the like, various methods utilizing grooves formed in a steel sheet have been developed as domain refining techniques which are endurable against the strain removing annealing. One of those techniques is represented, for example, by a method of locally forming a groove in a steel sheet after final finishing annealing so that a magnetic domain is refined due to the diamagnetic field effect produced by the formed groove. One example of methods for forming such a groove comprises the steps of locally removing an insulation coating and a primer coating by mechanical machining or irradiation of a laser beam, and then performing electrolyte etching (see Japanese Unexamined Patent Application Publication No. 63-76819).

Further, Japanese Examined Patent Application Publication No. 62-53579 discloses a method for refining a magnetic domain, wherein a steel sheet is subjected to strain removing annealing after impressing it with a gear-shaped roll, thereby achieving both groove formation and recrystallization. Additionally, Japanese Unexamined Patent Application Publication No. 59-197520 discloses a method for forming grooves in a steel sheet before finishing annealing.

It is known that, by applying those domain refining methods to a conventional grain-oriented electrical steel sheet, iron loss of a grain oriented electrical steel sheet having high magnetic flux density and having coarse crystal grains can effectively be reduced, and a value of iron loss is reduced as magnetic flux density $B_8$ increases. However, materials exhibiting even lower iron loss are demanded under recent energy situations, whereas a drastic improvement in iron loss is difficult to achieve with conventional domain refining techniques.

On the other hand, as one of technique for improving magnetic characteristics of a grain oriented electrical steel sheet based on steel composition, it is proposed to add Cr in steel.

Aiming at reducing iron loss of a grain oriented electrical steel sheet, for example, Japanese Unexamined Patent Application Publication No. 10-259424 discloses a method of adding a predetermined amount of silicon, chromium, manganese, etc. in a hot rolled sheet to increase electrical resistivity of the hot rolled sheet to a value not lower than 45 μΩ.cm, thereby reducing eddy current loss. Although the disclosed method proposes addition of Cr for increasing volume resistivity of a base material, it has not yet succeeded in realizing a high concentration of the grain direction and achieving a steel sheet with low iron loss, which has recently been demanded.

Also, Japanese Examined Patent Application Publication Nos. 62-54846 and 63-1371 and Japanese Unexamined Patent Application Publication Nos. 61-190017 and 2-228425 disclose techniques for adding Cr in a steel slab for the purpose of preventing deterioration of magnetic characteristics due to a change in the amount of acid-soluble Al.

Further, Japanese Unexamined Patent Application Publication Nos. 2-228425 and 5-78743, etc. disclose techniques for improving magnetic flux density with a combination of slab reheating at low temperature not higher than 1300° C. and nitriding after decarburization annealing, wherein Cr is contained in a steel slab to widen the range of Al content in which high magnetic flux density is obtained. Japanese Unexamined Patent Application Publication No. 11-217631 also discloses a technique wherein Cr is contained in a steel slab, which is subjected to slab reheating at low temperature and nitriding. However, this Publication aims to prevent deterioration in formation of a forsterite coating.

Moreover, in the technique disclosed in Japanese Unexamined Patent Application Publication No. 10-46297, Cr is contained in a product by a similar method, i.e., a combination of slab reheating at low temperature and nitriding with $NH_3$ gas after decarburization annealing. A primary action of added Cr is to develop a satisfactory internal coating.

Among the above-mentioned references regarding the techniques for addition of Cr, Japanese Unexamined Patent Application Publication Nos. 61-190017 makes studies as to whether the effect of reducing iron loss by domain refining is enhanced by irradiating a laser beam to a proposed grain oriented silicon steel sheet added with Cr. As a result of the studies, however, it is concluded that the effect of reducing iron loss by domain refining is hardly obtained for the steel sheet added with Cr. Any artificial domain refining techniques are not mentioned in the other references.

Meanwhile, Japanese Unexamined Patent Application Publication Nos. 9-202924, 10-130726, and 10-130727 disclose techniques for applying the domain refining treatment to a mirror-finished grain oriented electrical steel sheet. Disclosed examples include a steel sheet containing 0.12% of Cr in steel. However, those Publications neither describe the object of adding Cr, nor suggest s correlation between the addition of Cr and conditions for the domain refining treatment. Because a steel sheet is subjected to slab reheating at low temperature and nitriding, it is thought that the object of adding Cr in those Publications is the same as that in the above-mentioned techniques.

Thus, adding Cr in steel of a grain oriented electrical steel sheet is proposed as the technique for improving stability of a secondary recrystallized crystal and forming a satisfactory forsterite coating in the step of slab reheating at low temperature, or as the technique aiming at reducing iron loss of a steel sheet having low permeability with an increase in electrical resistivity. However, the concept of adding Cr with the intent to improve the effect of the domain refining treatment itself is not found in any known related art. Also, there are no references reporting any finding with respect to the relationship between conditions for the domain refining treatment and the Cr content.

Additionally, any method capable of effectively reducing iron loss of a low iron-loss steel sheet by the domain refining is not yet found, and in the present state of the art, a level of iron loss is hardly improved in comparison with a conventional one.

SUMMARY OF THE INVENTION

It would therefore be advantageous to provide a grain oriented electrical steel sheet, which has lower iron loss after domain refining than conventional values, and a production method for the same.

The inventors have studied various processes for effectively reducing iron loss after the domain refining. As a result, the inventors have discovered that the effect of the domain refining is improved beyond an expected level by adding Cr in metal part (or substrate steel or base metal; portion of a steel sheet except for a surface coating layers) of a steel sheet product and properly setting conditions for domain refining depending on the Cr content. Based on that discovery, the inventors have found a process capable of producing a steel product with lower iron loss than conventional values, and accomplished the invention.

The features of the invention are summarized below.

(I) A grain oriented electrical steel sheet with low iron loss, comprising metal part containing Si: about 2.5 to about 5.0 mass % and Cr: about 0.05 to about 1.0 mass %, and an insulation coating formed on a surface of the metal part and made up of a single layer or multiple layers, wherein, preferably, tension imparted to the metal part in the rolling direction by the insulation coating is not smaller than about 3.0 MPa, and wherein magnetic flux density ($B_8$) satisfies formula (1), a plurality of linear strains are induced near a surface of the steel sheet and linearly extended at an angle of not larger than about 45° (in each direction) to a direction perpendicular to a rolling direction, and an array interval D of the linear strains satisfies formula (2):

$$B_8 \geqq (2.21-0.0604(\mathrm{Si})-0.0294(\mathrm{Cr}))\times 0.960 \quad (1)$$

$$3+5(\mathrm{Cr}) \leqq D \leqq 11+5(\mathrm{Cr}) \quad (2)$$

wherein (Si) and (Cr) represent mass percentages of Si and Cr in the metal part of the grain oriented electrical steel sheet, a unit of $B_8$ is T, and a unit of D is mm.

(II) A grain oriented electrical steel sheet with low iron loss, comprising metal part containing Si: about 2.5 to about 5.0 mass % and Cr: about 0.05 to about 1.0 mass %, and an insulation coating formed on a surface of the metal part and made up of a single layer or multiple layers, wherein, preferably, tension imparted to the metal part in the rolling direction by the insulation coating is not smaller than about 3.0 MPa, and wherein magnetic flux density ($B_8$) satisfies formula (3), a plurality of grooves are formed in a surface of the metal part and linearly extend at an angle of not larger than about 45° (in each direction) relative to a direction perpendicular to a rolling direction, each of the grooves having a depth (d) preferably in the range of about 1.5 to about 15% of a metal part thickness, and an array interval D of the grooves satisfies formula (4):

$$B_8 \geqq (2.21-0.0604(\mathrm{Si})-0.0294(\mathrm{Cr}))\times 0.960-0.0030d \quad (3)$$

$$1+5(\mathrm{Cr}) \leqq D \leqq 8+5(\mathrm{Cr}) \quad (4)$$

wherein (Si) and (Cr) represent mass percentages of Si and Cr in the metal part of the grain oriented electrical steel sheet, a unit of $B_8$ is T, a unit of d is $\mu$m, and a unit of D is mm.

(III) In the grain oriented electrical steel sheet with low iron loss of above (I) or (II), of the layers (including a single layer)making up the insulation coating, the layer in contact with the metal part is made of forsterite as a main ingredient.

(IV) In the grain oriented electrical steel sheet with low iron loss of above (I), (II) or (III), a mean length of secondary recrystallized grains in the rolling direction is not less than about 30 mm.

(V) In the grain oriented electrical steel sheet with low iron loss of any one of above (I) to (IV), the metal part further contains Bi: about 0.0005 to about 0.08 mass %.

(VI) A method of producing a grain oriented electrical steel sheet with low iron loss, comprising preparing a steel slab containing:

| | |
|---|---|
| C: | about 0.01 to about 0.10 mass %, |
| Si: | about 2.5 to about 5.0 mass %, |
| Mn: | about 0.03 to about 0.20 mass %, |
| N: | about 0.0015 to about 0.0130 mass % |
| Cr: | about 0.05 to about 1.0 mass %, |

about 0.010 to about 0.030 mass %, in total, of one or more selected from S and Se, and one or more selected from sol. Al: about 0.015 to about 0.035 mass % and B: about 0.0010 to about 0.0150 mass %, hot rolling the steel slab to form a hot rolled sheet; obtaining a steel sheet with a final sheet thickness by, after optionally annealing a hot rolled sheet, carrying out cold rolling two or more times, including intermediate annealing one or more times, or by carrying out cold rolling once after annealing a hot rolled sheet; carrying out decarburization annealing and then final finishing annealing; applying an insulation coating agent to form an insulation coating; and carrying out flattening annealing, thereby obtaining a product, wherein the soaking temperature (T) in annealing before final cold rolling falls in a range expressed by formula (5), a plurality of linear strains are induced in a steel sheet after the flattening annealing to be linearly extended at an angle of not larger than about 45° (in each direction) relative to a direction perpendicular to a rolling direction, and an array interval D of the linear strains satisfies a relationship of formula (2) given below:

$$1000-200(\mathrm{Cr})\leqq T<1150-200(\mathrm{Cr}) \quad (5)$$

$$3+5(\mathrm{Cr})\leqq D\leqq 11+5(\mathrm{Cr}) \quad (2)$$

wherein (Si) and (Cr) represent mass percentages of Si and Cr in the metal part of the grain oriented electrical steel sheet, a unit of T is ° C., and a unit of D is mm.

(VII) A method of producing a grain oriented electrical steel sheet with low iron loss, comprising preparing a steel slab containing:

| | |
|---|---|
| C: | about 0.01 to about 0.10 mass %, |
| Si: | about 2.5 to about 5.0 mass %, |
| Mn: | about 0.03 to about 0.20 mass %, |
| N: | about 0.0015 to about 0.0130 mass %, |
| Cr: | about 0.05 to about 1.0 mass %, |

about 0.010 to about 0.030 mass %, in total, of one or more selected from S and Se, and one or more selected from sol. Al: about 0.015 to about 0.035 mass % and B: about 0.0010 to about 0.0150 mass %; hot rolling the steel slab; obtaining a steel sheet with a final sheet thickness by, after optionally annealing a hot rolled sheet, carrying out cold rolling two or more times, including intermediate annealing one or more times, or by carrying out cold rolling once after annealing a hot rolled sheet; carrying out decarburization annealing and then final finishing annealing; applying an insulation coating agent to form an insulation coating; and carrying out flattening annealing, thereby obtaining a product, wherein a soaking temperature (T) in annealing before final cold rolling falls in a range expressed by formula (5) given below, a plurality of grooves are formed in a steel sheet after the cold rolling step to linearly extend at an angle of not larger than about 45° (in each direction) relative to a direction perpendicular to a rolling direction, and an array interval D of the grooves satisfies a relationship of formula (4) given below:

$$1000-200(\mathrm{Cr})\leqq T\leqq 1150-200(\mathrm{Cr}) \quad (5)$$

$$1+5(\mathrm{Cr})\leqq D\leqq 8+5(\mathrm{Cr}) \quad (4)$$

wherein (Si) and (Cr) represent mass percentages of Si and Cr in the metal part of the grain oriented electrical steel sheet and wherein a unit of T is ° C., and a unit of D is mm.

(VIII) In the method of producing a grain oriented electrical steel sheet with low iron loss of above (VI) or (VII), the steel slab further contains Bi: about 0.001 to about 0.10 mass %.

BRIEF DESCRIPTION OF THE DRAWINGS

FIG. 1A shows the case in which Cr is contained in metal part (Cr: 0.29 mass %), and FIG. 1B shows the case in which Cr is not contained in metal part.

DESCRIPTION OF PREFERRED EMBODIMENTS

Figure 1A:
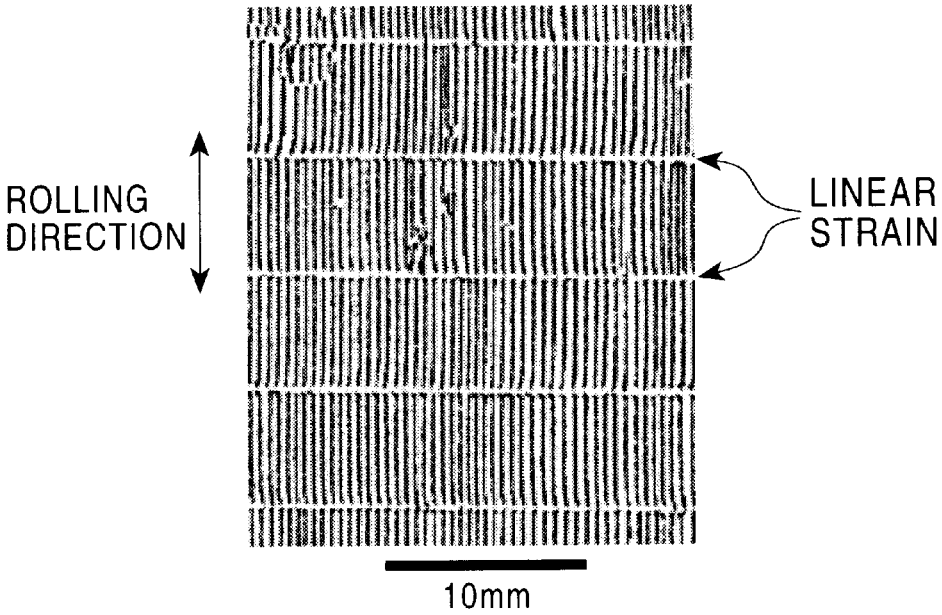
FIGS. 1A and 1B show, in comparison, magnetic domain patterns after domain refining between when Cr is contained in metal part of a grain oriented electrical steel sheet (product) and when Cr is not contained therein. Specifically.

A description is now made of selected embodiments of the invention, including selected experiments.

First, steel ingots each being 100 kg and having composition shown in Table 1 were prepared. In the compositions of those steel ingots, with respect to the standard composition (Si=3.3 mass %), amounts of elements to be added, such as Cr, Mn, Al and P, were adjusted so as to provide an increase in electrical resistivity (i.e., increase of 1.2 $\mu\Omega$.cm), which corresponded to an increase of 0.2 mass % in Si amount.

Then, each of the steel ingots was heated to 1400° C. and subjected to hot rolling to obtain a hot rolled sheet having a thickness of 2.5 mm. Thereafter, the hot rolled sheet was annealed at a soaking temperature of 900° C. for a soaking time of 100 seconds. After pickling of the annealed sheet, a steel sheet having an intermediate thickness of 1.5 mm was obtained by cold rolling. Subsequently, the steel sheet was subjected to intermediate annealing at around 1000° C. for 100 seconds. After pickling, the steel sheet was rolled at a maximum attainment temperature of 200° C. to obtain a finish sheet thickness of 0.23 mm. After degreasing, the steel sheet was subjected to decarburization annealing, which also served as primary recrystallization annealing, at 850° C. for 120 seconds. After coating and drying an annealing separator that contained MgO as a main ingredient and 5% of $TiO_2$, the steel sheet was subjected to final finishing annealing at a maximum temperature of 1200° C. Subsequently, an insulation coating for imparting tension to metal part in the rolling direction was formed by applying and baking an insulation coating agent, which contained as a main ingredient magnesium phosphate and colloidal silica, in amount of 5 g/m$^2$ for each surface of the steel sheet. The resulting insulation coating was a composite coating made up of a forsterite layer and a phosphate-based glass coating (forsterite layer mainly exist on a metal part), and the tension in the rolling direction imparted to the metal part by the insulation coating was 4.7 MPa.

Epstein test pieces were sampled from each steel sheet obtained by the above-described process, and the magnetic flux density $B_8$ of each test piece was measured using an SST (Single Sheet Magnetic Tester). Then, 16 test pieces for each steel having $B_8$ of 1.93±0.003T were selected, and iron loss $W_{17/50}$ (iron loss at Bm=1.7T, 50 Hz) of each test piece was measured in accordance with the Epstein test procedure (calibrated corresponding to unit weight of 500 g). Then, domain refining treatment was performed on the test piece by inducing linear strains therein with a plasma flame at an interval of 6 mm and at an angle of 10° relative to a direction perpendicular to a rolling direction. Thereafter, iron loss $W_{17/50}$ of the treated test piece was measured in accordance with the Epstein test procedure. Further, a mean magnetic domain width of each test piece after the domain refining was measured by observing magnetic domains with the colloid process. Measured results are listed in Table 1 given below.

TABLE 1

| Steel ingot | Composition of steel slab (mass %) | | | | | | | | | | Iron Loss $W_{17/50}$ (W/kg) | | Mean magnetic domain width (mm) | |
|---|---|---|---|---|---|---|---|---|---|---|---|---|---|---|
| Symbol | C | Si | Mn | P | S | Al | Se | Sb | N | Cr | Before domain refining | After domain refining | After domain refining | Remarks |
| 1A | 0.06 | 3.30 | 0.07 | 0.004 | 0.003 | 0.025 | 0.025 | 0.03 | 0.009 | 0.01 | 0.962 | 0.774 | 0.230 | Standard |
| 1B | 0.06 | 3.50 | 0.07 | 0.004 | 0.003 | 0.026 | 0.024 | 0.03 | 0.009 | 0.01 | 0.940 | 0.760 | 0.228 | Increase of Si amount |
| 1C | 0.06 | 3.30 | 0.42 | 0.004 | 0.003 | 0.026 | 0.025 | 0.03 | 0.009 | 0.01 | 0.939 | 0.761 | 0.227 | Increase of Mn amount |
| 1D | 0.06 | 3.30 | 0.07 | 0.004 | 0.003 | 0.185 | 0.025 | 0.03 | 0.009 | 0.01 | 0.938 | 0.762 | 0.230 | Increase of Al amount |
| 1E | 0.06 | 3.30 | 0.07 | 0.15 | 0.003 | 0.025 | 0.025 | 0.03 | 0.009 | 0.01 | 0.939 | 0.762 | 0.228 | Increase of P amount |
| 1F | 0.06 | 3.30 | 0.07 | 0.004 | 0.003 | 0.025 | 0.025 | 0.03 | 0.009 | 0.29 | 0.939 | 0.713 | 0.229 | Increase of Cr amount |

As seen from the results listed in Table 1, steel sheets 1B–1E, in which Si, Mn, Al and P were added in such amounts as to increase the electrical resistivity by 1.2 $\mu\Omega$.cm from that of a standard steel sheet 1A, had iron losses $W_{17/50}$ lower than that of the standard steel sheet 1A by about 0.02 W/kg before the domain refining and about 0.01 W/kg after the domain refining. An improvement in iron loss of 0.01 W/g after the domain refining substantially corresponds to a reduction in eddy current loss (i.e., the sum of classical eddy current loss and abnormal eddy current loss), which resulted when the electrical resistivity is increased about 1.2 $\mu\Omega$.cm in a base material having a sheet thickness of about 0.23 mm and a magnetic domain width of 0.23 mm.

In contrast, for a steel sheet 1F in which Cr was added in such an amount as to increase the electrical resistivity by 1.2 $\mu\Omega$.cm from that of the standard steel sheet 1A, iron loss before the domain refining had a value not so much different from those of the iron sheets 1B–1E, but iron loss after the domain refining was lower than that of the standard steel sheet 1A by about 0.06 W/kg, i.e., even lower than those of the steel sheets 1B–1E. Such an improvement obtained in the steel sheet 1F was much greater than an improvement in eddy current loss resulting from an increase in electrical resistivity. Thus, it was made apparent that addition of Cr is effective in further reducing iron loss of a steel sheet after the domain refining.

Also, as a result of conducting similar experiments on steel sheets treated by a domain refining method of forming grooves on the surface of each steel sheet, it was confirmed that similar effects as those described above were obtained.

The reason why iron loss after the domain refining was reduced by addition of Cr is not yet fully clarified, but presumably resides in that the addition of Cr improves adhesion between the metal part and the forsterite coating and, therefore, tension in the insulation coating is effectively transmitted to the metal part in local areas near the linear strains or grooves, whereby disorder of magnetic domains caused by the presence of the linear strains or grooves is suppressed.

Figure 1B:
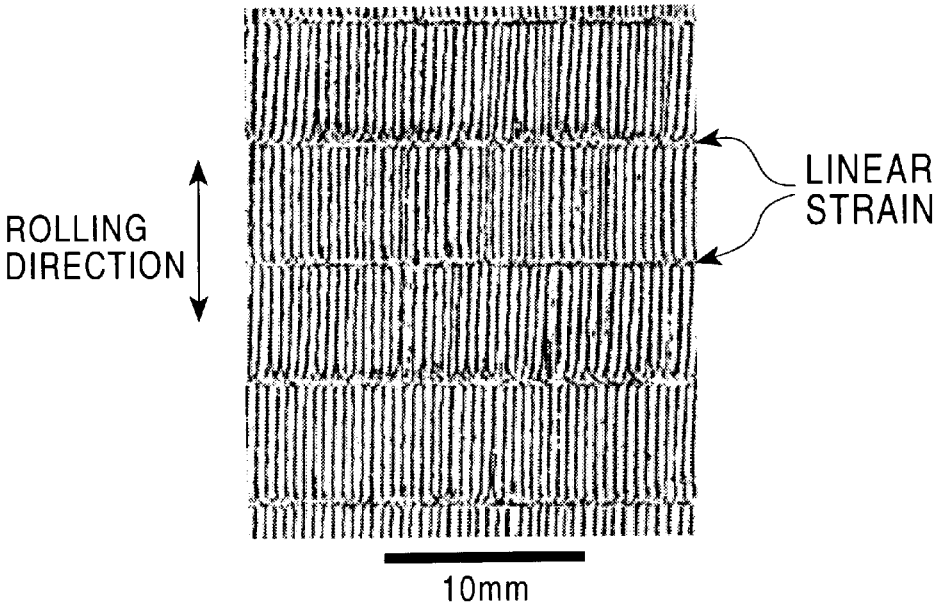

FIGS. 1A and 1B show the results obtained by carrying out the domain refining treatment on each test piece with a plasma flame, demagnetizing it, and then observing magnetic domains by the magnetic colloid process in a state where a vertical magnetic field of 4000 A/m was applied to the test piece. FIG. 1A represents steel containing Cr, and FIG. 1B represents steel not containing Cr. As seen from FIGS. 1A and 1B, disorder of 180°-magnetic domain patterns is observed in the steel not containing Cr near the linear strains, while disorder of 180°-magnetic domain patterns is significantly suppressed in the steel containing Cr near the linear strains. Thus, in the steel containing Cr, since disorder of 180°-magnetic domain patterns is suppressed, a lower value of iron loss can be obtained after the domain refining.

Also, when carrying out the domain refining treatment by formation of grooves, it is presumed that although disorder of magnetic domains is not significant in a demagnetized state after strain removing annealing, closure domains (spike-shaped domains) are generated near the grooves and iron loss is increased with the progress of magnetization. Even in such a case, however, since addition of Cr in steel improves adhesion between the metal part and the forsterite coating, disorder of the domain structure caused in a magnetizing process is also prevented and iron loss is reduced.

The reason why the effect of reducing iron loss was enhanced particularly in a steel sheet subjected to the domain refining treatment in comparison with a steel sheet not subjected to the domain refining treatment, presumably resides in not only tension in the coating acting upon the metal part, but also enhanced adhesion between the forsterite coating and the metal part, which ensures a sufficient tension in the coating even in the very close vicinity of the linear strains or grooves and, hence, significantly suppresses disorder of the domain structure.

From the above findings, it became apparent that a further reduction in iron loss is achievable in a steel sheet containing Cr and subjected to the domain refining. It was, however, also confirmed that low iron loss was not always achieved even in a steel sheet containing Cr and subjected to the domain refining. As a result of studying the cause in detail, it was found that proper conditions for the domain refining differed depending on the Cr content. Results of the studies on the proper conditions for the domain refining will be described below.

A 100 kg steel ingot was prepared which contained, by mass %, C: about 0.06%, Si: about 3.3%, Mn: about 0.07%, Al: about 0.025%, Se: about 0.02%, Sb: about 0.03%, N: about 0.009%, P: about 0.003% and S: about 0.003%, and also contained Cr in the range of about 0 to about 1.1 mass %, the balance being primarily iron. From such a steel ingot, grain oriented electrical steel sheets were produced in the same manner as that described above, and then subjected to the domain refining by two methods; i.e., (1) one comprising the steps of applying and baking an insulation coating agent to form an insulation coating, and then inducing linear strains in the steel sheet with a plasma flame, (2) the other comprising the step of, after final cold annealing, forming linear grooves by resist etching. In method (1), an angle formed between the rolling direction and an extending direction of the linear strains was set to 80° and an array interval of the linear strains was changed in the range of about 1.5 to about 17.0 mm. In method (2), an angle formed between the rolling direction and an extending direction of the linear grooves was set to 80°, a depth of each linear groove was set to 15 $\mu$m, and an array interval of the linear grooves was changed in the range of about 1.5 to about 17.5 mm. A tension imparted from the coating to metal part of the obtained steel sheet was 5.0 MPa, and an influence of the grooves upon the imparted tension was not appreciable.

Figure 2:
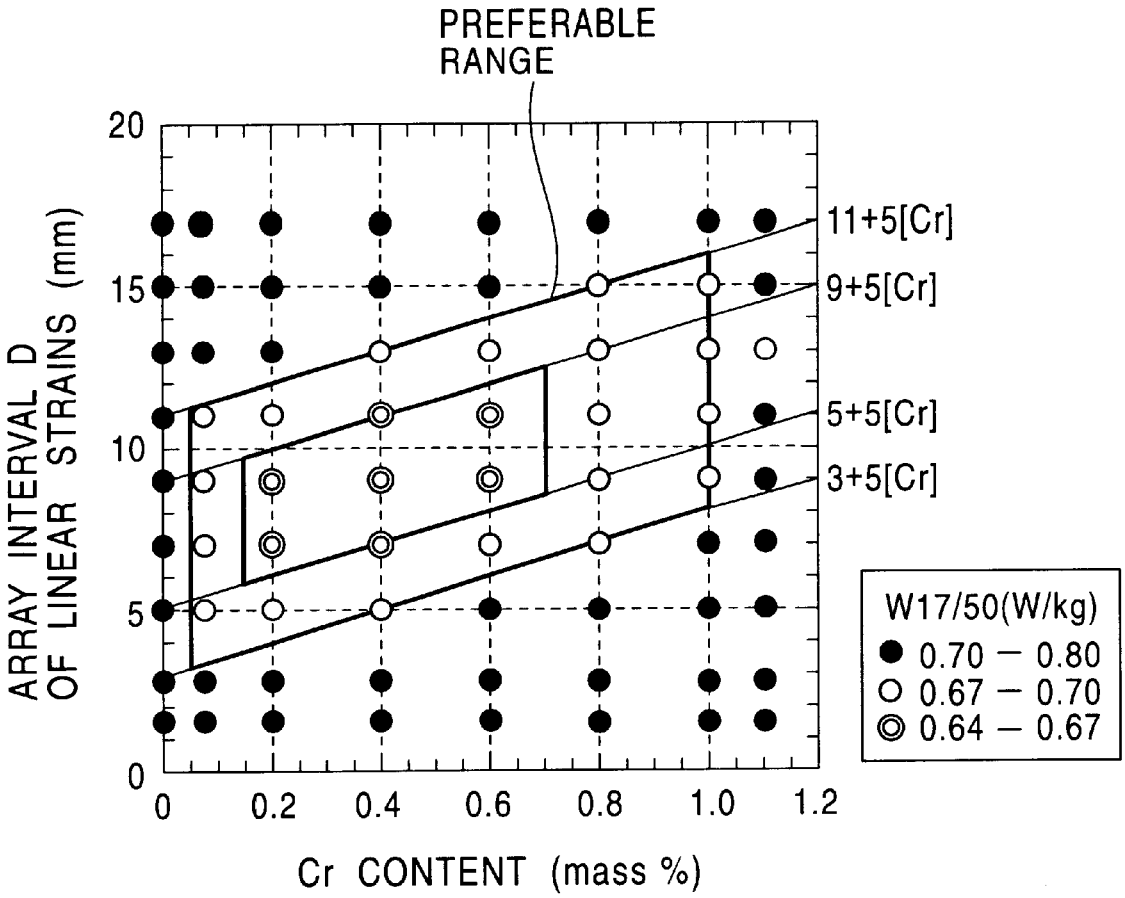
FIG. 2 is a graph showing relationships of iron loss $W_{17/50}$ versus Cr content and an array interval (pitch) D of linear strains when the domain refining is performed by inducing the linear strains in the steel sheet.
Figure 3:
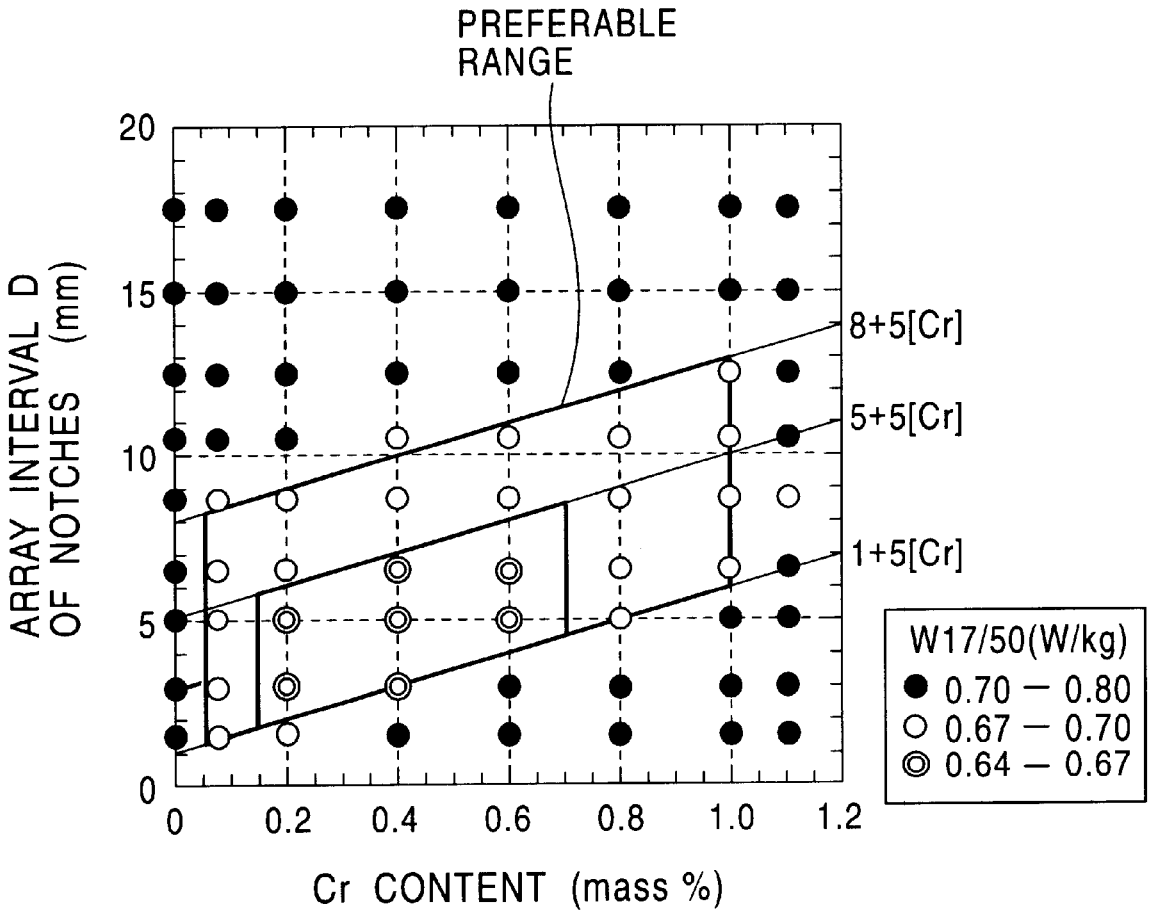
FIG. 3 is a graph showing relationships of iron loss $W_{17/50}$ versus Cr content and an array interval D of linear grooves when the domain refining is performed by forming the linear grooves in the steel sheet.

Iron loss $W_{17/50}$ of each of the thus-obtained test pieces was measured in accordance with the Epstein test procedure (calibrated corresponding to unit weight of 500 g). FIG. 2 is a graph plotting the iron loss $W_{17/50}$ of the product (test piece) resulting when the array interval (mm) of the linear strains and the Cr content (mass %) in metal part of the product were changed. FIG. 3 is a graph plotting the iron loss $W_{17/50}$ of the product (test piece) resulting when the array interval (mm) of the linear grooves and the Cr content (mass %) in metal part of the product were changed. In FIGS. 2 and 3, a mark "⊙" (double circle) represents the product in which the iron loss $W_{17/50}$ is not larger than 0.67 W/kg, a mark "○" (open circle) represents the product in which the iron loss $W_{17/50}$ is larger than 0.67 W/kg but not larger than 0.70 W/kg, and a mark "●" (solid circle) represents the product in which the iron loss $W_{17/50}$ is larger than 0.70 W/kg.

As seen from the results plotted in the graphs of FIGS. 2 and 3, low iron loss is achieved by controlling the array interval of the linear strains or grooves, which are formed by the domain refining treatment, so as to fall in the proper range depending on the Cr content. If the array interval is outside the proper range, the iron loss reducing effect with addition of Cr cannot be obtained sufficiently.

More specifically, from FIGS. 2 and 3, it is understood that when employing the domain refining treatment with linear strains induced in the steel sheet after flattening annealing (this treatment is generally called a non-heatproof domain refining treatment because the strains are disappeared upon reheating), iron losses of all the products obtained by controlling the Cr content to be kept in the range of 0.05 to 1.0 mass % and the array interval D (mm) of the linear strains to be kept in the range of 3+5(Cr) (mass %) to 11+5(Cr) (mass %) have low values not larger than 0.70 W/kg. Also, by controlling the Cr content to be kept in the range of about 0.15 to about 0.7 mass % and the array interval D (mm) of the linear strains to be kept in the range of about 5+5 (Cr) (mass %) to about 9+5(Cr) (mass %), iron losses of all the products are further reduced to values not larger than 0.67 W/kg.

On the other hand, it is understood that when employing the domain refining treatment with linear grooves formed in the steel sheet (this treatment is generally called a heatproof domain refining treatment because the grooves do not disappear upon reheating), iron losses of all the products obtained by controlling the Cr content to be kept in the range of 0.05 to 1.0 mass % and the array interval D (mm) of the linear grooves to be kept in the range of 1+5(Cr) (mass %) to 8+5(Cr) (mass %) have low values not larger than 0.70 W/kg. Also, by controlling the Cr content to be kept in the range of about 0.15 to about 0.7 mass % and the array interval D (mm) of the linear grooves to be kept in the range of about 1+S(Cr) (mass %) to about 5+5(Cr) (mass %), iron losses of all the products are further reduced to values not larger than 0.67 W/kg.

As described above, both an increase in the Cr content and implementation of the domain refining treatment have an action to reduce iron loss of the product. However, any of the increased Cr content and the domain refining treatment also has an action to reduce permeability. Therefore, if the Cr content is increased and the domain refining treatment is carried out at the same time to an excessive extent, permeability would be significantly reduced due to a synergetic effect, and hysteresis loss would be increased. For those reasons, the proper conditions for the domain refining differ depending on the Cr content. Accordingly, it was confirmed that an effective reduction in iron loss requires it to reduce a density, at which the linear strains or grooves are formed for the domain refining, corresponding to an increase in the Cr content, i.e., to widen the array interval D of the linear strains or grooves as seen from FIGS. 2 and 3.

The reason why the proper range of the array interval D differs between the case of inducing the linear strains and the case of forming the linear grooves, is presumably in that the amount and distribution of magnetic poles produced in the steel sheet differs between the case of inducing the linear strains and the case of forming the linear grooves. More specifically, in the case of inducing the linear strains with a laser beam or a plasma flame, since stress-pattern magnetic domains are generated throughout the thickness of the steel sheet, the effect obtainable with the domain refining is increased, but at the same time a reduction in permeability is also increased. For that reason, the array interval D is required to have a relatively large value. On the other hand, in the case of forming the linear grooves, since magnetic poles are generated only in a surface layer of the steel sheet unlike the case of inducing the linear strains, the effect obtainable with the domain refining is small. For that reason, the array interval D must be set to a relatively small value.

Further, aligning the grain direction [001] with the rolling direction is an essential condition for achieving low iron loss after the domain refining treatment. Hitherto, a concentration of the [001] orientation has generally been evaluated based on $B_8$ that represents magnetic flux density at a magnetizing force of 800 A/m. However, since $B_8$ is changed depending not only on the grain direction, but also the saturated magnetic flux density and the presence of grooves, the evaluation simply based on $B_8$ is not enough to estimate a level of iron loss after the domain refining treatment. Also, a method of determining the direction of each secondary recrystallized grain by, e.g., X-ray diffraction has a difficulty in obtaining a satisfactory level of accuracy, and it cannot be used as providing an absolute index when determining the conditions for the domain refining treatment after final finishing annealing in a production line.

In view of the above situation, the inventors made efforts to establish determination criteria of $B_8$ for achieving low iron loss by the domain refining treatment. In those efforts, attention was focused on the saturated magnetic flux density of a base material and the depth of the linear grooves as $B_8$-affecting factors other than the grain direction. Note that, for a variation of $B_8$ due to the presence of linear strains, a reduction of $B_8$ due to the presence of linear strains is about 0.005T at a maximum and, hence, negligible when the array interval D of the linear strains satisfies(2), described later.

The saturated magnetic flux density $B_8$ of a product primarily depends on composition of a base material, such as Si and Cr. When Si and Cr are added in the range of 2.5 to 5.0 mass % and 0.05 to 1.0 mass %, respectively, the saturated magnetic flux density can be expressed by:

$$B_8=2.21-0.0604(\mathrm{Si})-0.0294(\mathrm{Cr})$$

For the purpose of determining a value of $B_8$ that is required to achieve low iron loss after the domain refining, grain oriented electrical steel sheets were produced from steel ingots 2A to 2N containing, by mass %, C: about 0.06%, Mn: about 0.07%, Se: about 0.02%, Cu: about 0.1%, Al: about 0.02%, N: about 0.009%, P: about 0.004% and S: about 0.003%, and also containing Si and Cr in amounts listed in Table 2 given below. Then, the steel sheets were subjected to the domain refining treatment through the same process as that described above. In the process, the soaking temperature in intermediate annealing (annealing before final cold rolling) was set as listed in Table 2. The domain refining was carried out on the steel sheets produced from the ingots 2A to 2I by inducing linear strains with a plasma flame, and on the steel sheets produced from the ingots 2J to 2N by forming grooves after the final cold rolling. Tension imparted by an insulation coating had the same value as that obtained with the above-described experiments providing the results of FIGS. 2 and 3.

TABLE 2

| Steel symbol | Si (mass %) | Cr (mass %) | Domain refining method | Groove depth d (mm) | $B_0$ (k=0.960) | $B_0$ (k=0.970) | Intermediate annealing temperature (° C.) | $B_8$ (T) | $W_{17/50}$ (W/kg) | Remarks |
|---|---|---|---|---|---|---|---|---|---|---|
| 2A | 3.0 | 0.07 | Plasma flame irradiation | — | 1.946 | 1.966 | 1100 | 1.951 | 0.682 | Inventive example |
| | | | | | | | 1150 | 1.932 | 0.754 | Comparative example |
| 2B | 3.2 | 0.07 | Plasma flame irradiation | — | 1.934 | 1.954 | 1100 | 1.962 | 0.622 | Inventive example |
| | | | | | | | 1150 | 1.930 | 0.726 | Comparative example |
| 2C | 3.4 | 0.07 | Plasma flame irradiation | — | 1.922 | 1.943 | 1100 | 1.932 | 0.684 | Inventive example |
| | | | | | | | 1150 | 1.915 | 0.749 | Comparative example |
| 2D | 3.6 | 0.07 | Plasma flame irradiation | — | 1.911 | 1.931 | 1100 | 1.915 | 0.692 | Inventive example |
| | | | | | | | 1150 | 1.902 | 0.746 | Comparative example |
| 2E | 3.8 | 0.07 | Plasma flame irradiation | — | 1.899 | 1.919 | 1100 | 1.925 | 0.613 | Inventive example |
| | | | | | | | 1150 | 1.888 | 0.739 | Comparative example |
| 2F | 3.3 | 0.15 | Plasma flame irradiation | — | 1.926 | 1.946 | 1100 | 1.952 | 0.611 | Inventive example |
| | | | | | | | 1150 | 1.920 | 0.728 | Comparative example |
| 2G | 3.3 | 0.30 | Plasma flame irradiation | — | 1.922 | 1.942 | 1000 | 1.942 | 0.624 | Inventive example |
| | | | | | | | 1100 | 1.917 | 0.721 | Comparative example |
| 2H | 3.3 | 0.50 | Plasma flame irradiation | — | 1.916 | 1.936 | 1000 | 1.946 | 0.618 | Inventive example |
| | | | | | | | 1100 | 1.912 | 0.721 | Comparative example |
| 2I | 3.3 | 0.70 | Plasma flame irradiation | — | 1.910 | 1.930 | 1000 | 1.923 | 0.654 | Inventive example |
| | | | | | | | 1100 | 1.909 | 0.729 | Comparative example |
| 2J | 3.3 | 0.07 | Groove formation | 15 | 1.883 | 1.903 | 1050 | 1.905 | 0.644 | Inventive example |
| | | | | | | | 950 | 1.867 | 0.756 | Comparative example |
| 2K | 3.3 | 0.15 | Groove formation | 15 | 1.881 | 1.901 | 1050 | 1.909 | 0.622 | Inventive example |
| | | | | | | | 950 | 1.877 | 0.725 | Comparative example |
| 2L | 3.3 | 0.30 | Groove formation | 15 | 1.877 | 1.897 | 1000 | 1.898 | 0.637 | Inventive example |
| | | | | | | | 900 | 1.869 | 0.734 | Comparative example |
| 2M | 3.3 | 0.30 | Groove formation | 20 | 1.862 | 1.882 | 970 | 1.872 | 0.649 | Inventive example |
| | | | | | | | 920 | 1.856 | 0.739 | Comparative example |
| 2N | 3.3 | 0.30 | Groove formation | 25 | 1.847 | 1.867 | 1030 | 1.881 | 0.615 | Inventive example |
| | | | | | | | 920 | 1.841 | 0.729 | Comparative example |

As an index for estimating the concentration of the grain direction in comparison with $B_8$, a value $B_0$ was defined which is expressed by the following formula (*) depending on the amount of Si and Cr in a base material and the groove depth. In the formula (*), a parameter k represents a coefficient multiplied by $B_S$ that is estimated from the composition of the base material, and corresponds to a ratio of $B_8$ to $B_S$. Also, since $B_8$ is reduced about 0.0030d depending on the groove depth d ($\mu$m), a value of 0.0030d must be subtracted in the case of forming the grooves.

$$B_0(k)=(2.21-0.0604(\mathrm{Si})-0.0294(\mathrm{Cr}))\times k-0.0030d\ (\mu\mathrm{m}) \qquad (*)$$

(d=0 $\mu$m in the case of inducing the linear strains)

As seen from Table 2, the iron loss $W_{17/50}$ of the product has a small value not larger than 0.70 W/kg when $B_8$ is not lower than $B_0$ (k=0.960) expressed by the above formula (*), and the products with the iron loss $W_{17/50}$ having smaller values not larger than 0.67 W/kg are obtained when $B_8$ is not lower than $B_0$ (k=0.970).

From the above results, in the products subjected to the domain refining by inducing the linear strains, $B_8$ is required to satisfy the following formula (1):

$$B_8 \geqq (2.21-0.0604(\mathrm{Si})-0.0294(\mathrm{Cr}))\times 0.960 \quad (1)$$

On the other hand, in the products subjected to the domain refining by forming the grooves, because $B_8$ is reduced in proportion to the groove depth d, the condition required for achieving low iron loss is expressed by the following formula (3) that includes a correction term for the groove depth d;

$$B_8 \geqq (2.21-0.0604(\mathrm{Si})-0.0294(\mathrm{Cr}))\times 0.960-0.0030d \quad (3)$$

In order to obtain products having even lower iron loss, it is desired that $B_8$ satisfies the formula in which the coefficient of 0.960 in the right side of the formula (1) or (3) is replaced with 0.970.

Furthermore, as seen from the results of Table 2, it is important to properly set the annealing temperature before the final cold rolling for stably obtaining the products having high $B_8$ as described above.

A description is now made of results of studying an appropriate production process when a grain oriented electrical steel sheet is produced from a base material containing Cr.

A steel ingot containing, by mass %, C: about 0.06%, Si: about 3.3%, Mn: about 0.07%, Se: about 0.02%, Cu: about 0.1%, Al: about 0.02%, N: about 0.009%, P: about 0.003% and S: about 0.004%, and also containing Cr in the range of 0.1 to 1.0% was heated to 1400° C. and subjected to hot rolling to obtain a hot rolled sheet having a thickness of 2.5 mm. Thereafter, the hot rolled sheet was annealed at a soaking temperature of 900° C. for a soaking time of 100 seconds. After pickling of the annealed sheet, a steel sheet having an intermediate thickness of 1.5 mm was obtained by cold rolling. Subsequently, the steel sheet was subjected to intermediate annealing at 780 to 1160° C. for 100 seconds. After pickling, the steel sheet was rolled at a maximum attainment temperature of 200° C. to obtain a finish sheet thickness of 0.23 mm. After degreasing, the steel sheet was subjected to decarburization annealing, which also served as primary recrystallization annealing, at 850° C. for 120 seconds. After coating and drying an annealing separator that contained MgO as a main ingredient and 5% of $TiO_2$, the steel sheet was subjected to final finishing annealing at a maximum temperature of 1200° C. Subsequently, an insulation coating was formed by applying and baking an insulation tensile coating agent, which contained as a main ingredient magnesium phosphate and colloidal silica, in an amount of 5 g/m$^2$ for each surface of the steel sheet. Then, domain refining treatment was performed on the steel sheet by linearly irradiating a plasma flame at an interval of 8 mm and at an angle of 80° relative to the rolling direction. Tension in the rolling direction imparted to the metal part by the insulation coating was 5.1 Mpa.

Epstein test pieces were sampled from the steel sheet obtained by the above-described process, and iron loss $W_{17/50}$ of each test piece was measured.

Figure 4:
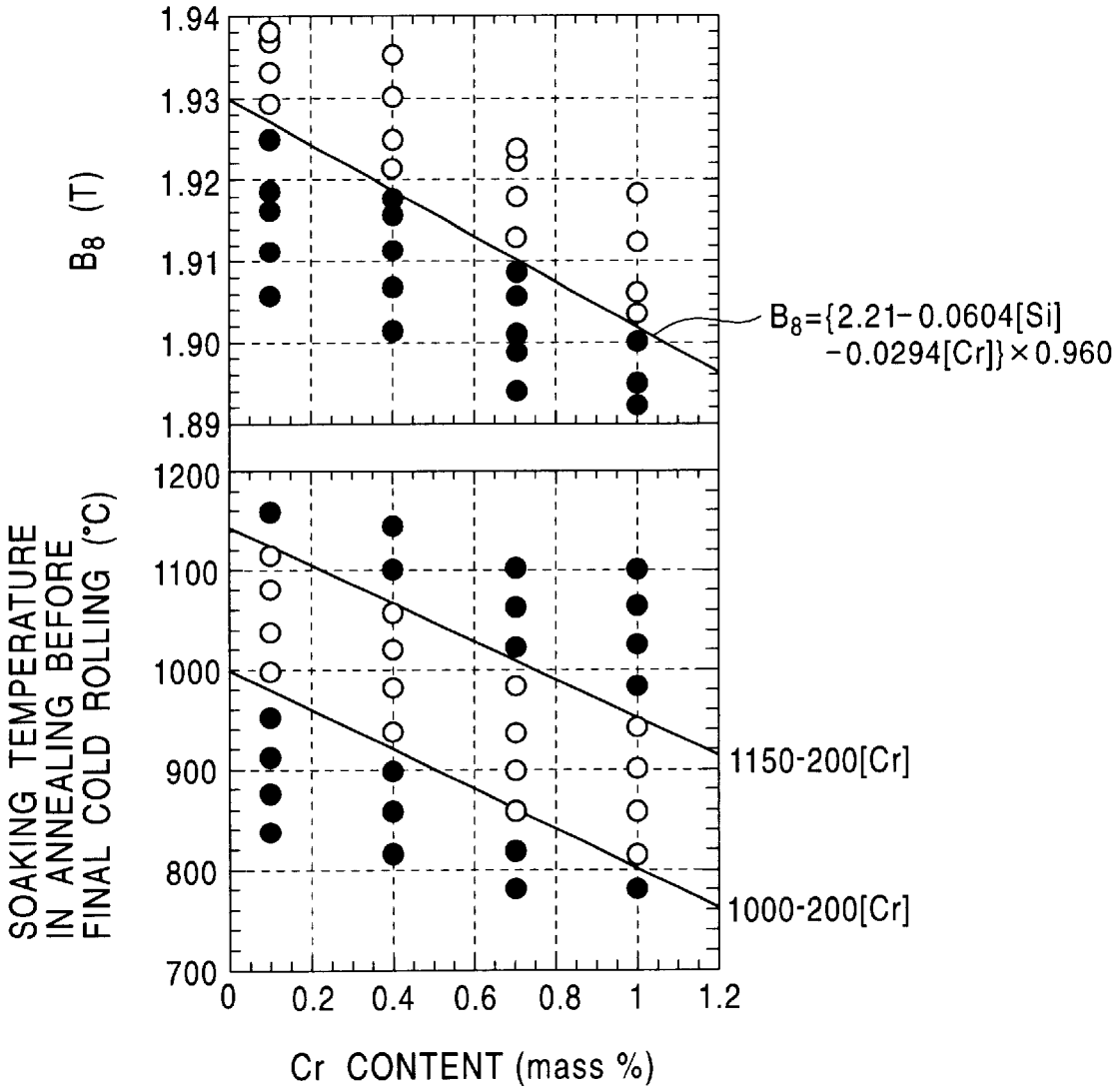
FIG. 4 is a graph showing changes in magnetic flux density $B_8$ of the product resulting when the amount of Cr added and the soaking temperature in intermediate annealing (annealing before final cold rolling) are changed.

An upper graph of FIG. 4 shows the relationship between the amount of Cr added and $B_8$, and a lower graph of FIG. 4 shows relationships among amount of Cr added, intermediate annealing temperature and $B_8$. Note that, in FIG. 4, a mark "○" (open circle) represents the test piece in which $B_8$ satisfies the relationship of the formula (1), and a mark "●" (solid circle) represents the test piece in which $B_8$ does not satisfy the relationship of the formula (1).

As seen from the lower graph of FIG. 4, by properly controlling the annealing temperature before the final cold rolling depending on the amount of Cr added, a grain oriented electrical steel sheet having a high concentration of the grain direction, at which the condition of the formula (1) or (3) is satisfied, can be obtained.

The above-described phenomenon, wherein the proper range of the annealing temperature before the final cold rolling is changed depending on the amount of Cr added, is presumably attributable to the fact that an increase in grain size of AlN, serving as an inhibitor, is promoted with addition of Cr. Thus, it is believed that by lowering the annealing temperature before the final cold rolling depending on an increase in the amount of Cr added, the Ostward growth of AlN is prevented and a proper inhibition effect is ensured, whereby a secondary recrystallized structure is obtained in satisfactory form.

The invention has been accomplished primarily based on the findings described above. The composition of the grain oriented electrical steel sheet and the production method according to the present invention will be described below in connection with requirements for obtaining the advantages of the invention, respective ranges of the requirements, and effects.

A description is first made of constituent features of the grain oriented electrical steel sheet (product) of the present invention and reasons for limitation of preferred conditions.

(I) Metal Part Composition

Si: about 2.5 to about 5.0 mass %

Si is an element required for increasing electrical resistance to reduce iron loss, stabilizing the α phase of iron, and enabling heat treatment to be performed at high temperature. When producing a material of low iron loss intended by the invention, at least about 2.5 mass % is required from the standpoint of reducing eddy current loss. However, if the Si content exceeds more than about 5.0 mass %, it would be difficult to perform cold rolling. Therefore, the Si content was limited to the range of about 2.5 to about 5.0 mass %.

Cr: about 0.05 to about 1.0 mass %

Cr is an important ingredient in the invention. Cr in the metal part can be regarded as having actions to enhance adhesion between a forsterite coating and the metal part, and to hold a sufficient tension effect even in an area, e.g., the vicinity of the linear strains or grooves, where disorder of the magnetic domain structure is apt to occur, thereby effectively reducing iron loss of the steel sheet subjected to the domain refining. Such an improvement in adhesion of the coating is presumably achieved through the steps of decarburization annealing, final finishing annealing, and flattening annealing. As conventionally known in the art, Cr also has an action to increase electrical resistivity of the metal part and contribute to reducing eddy current loss, and further has an advantage in suppressing deterioration of rolling characteristics. Due to the above-described actions developed with addition of Cr, therefore, iron loss can effectively be reduced. However, if the Cr content in the metal part is lower than about 0.05 mass %, the foregoing effects could not be obtained. Conversely, if the Cr content exceeds above about 1.0 mass %, there would occur such phenomena as a reduction in the saturated magnetic flux density and deteriorated dispersion of inhibitors due to an increased amount of coarse Cr precipitates, thus resulting in unsatisfactory magnetic characteristics. For those reasons, the Cr content in the metal part was limited to the range of about 0.05 to about 1.0 mass %.

In the invention, it is just required to limit only Si and Cr in the composition of the metal part so as to fall in the respective ranges mentioned above. Other ingredients are not limited to particular ranges so long as their contents are within respective ranges required for producing a grain oriented electrical steel sheet, but Bi may selectively be contained.

A general composition of metal part of the grain oriented electrical steel sheet contains, in addition to Si and Cr, Mn: about 0.03 to 1.0 mass %, and also contains, as typical unavoidable impurities, C: not more than about 0.0050 mass %, P: not more than about 0.05 mass %, S: not more than about 0.0050 mass %, Al: not more than about 0.0050 mass %, N: not more than about 0.0050 mass %, 0: not more than about 0.0050 mass %, and Se: not more than about 0.0050 mass % (including zero, i.e., a value less than an analysis limit value). Depending on particular purposes, the steel sheet may also contain Cu: not more than about 0.4 mass %, Mo: about 0.05 mass %, Sb: not more than about 0.1 mass %, Sn: not more than about 0.5 mass %, Ni: not more than about 0.5 mass %, and Ge: not more than about 0.2 mass %. Those elements are preferably added in amount not less than about 0.01 mass %, but they may be often contained in the steel unavoidably in trace amounts not larger than the above respective values.

Note that when those elements are employed as, e.g., inhibitors described later, they may be added at values departing from the above ranges.

Bi: about 0.0005 to about 0.08 mass %

Bi is an ingredient acting to inhibit growth of normal grains. By adding Bi in the metal part in the range of about 0.0005 to about 0.08 mass %, it is possible to increase a concentration of Goss orientation so as to satisfy the conditions of the formulae (1) and (2), and to satisfy the condition for producing secondary recrystallized grains that have a mean length of not less than about 30 mm in the rolling direction. Those effects are presumably attributable to the fact that addition of Bi improves the effect of inhibiting growth of normal grains, and fine primary recrystallized grains are held up to a high temperature range, whereby driving forces in encroachment by the secondary recrystallized grains are increased.

When a certain amount of Bi having those actions remains in the metal part of the product without excessively disappearing from the steel during the final finishing annealing, the effect of inhibiting growth of normal grains is held until a high temperature range, and a higher concentration of Goss orientation is realized. In addition, the secondary recrystallized grains are allowed to grow sufficiently in the rolling direction. However, if the amount of Bi in the metal part is lower than about 0.0005 mass %, the effect of inhibiting growth of normal grains would be insufficient. Conversely, if the amount of Bi exceeds above about 0.08 mass %, hysteresis loss would be increased due to an increase in the number of precipitate particles. For those reasons, the Bi content is preferably limited to the range of about 0.0005 to about 0.08 mass %.

(II) Tension in Rolling Direction Imparted from Insulation Coating to Metal Part Being not Less than about 3.0 MPa (Preferable)

When grain oriented electrical steel sheets are used in a transformer or the like, iron loss would be increased due to an increase in eddy current loss if the laminated steel sheets contact with each other. In an extreme case, generated heat could cause trouble in the transformer.

Also, to achieve a reduction in iron loss after the artificial domain refining, a coating on the steel sheet surface preferably imparts a sufficient tension to the steel sheet in the rolling direction. This is because even when magnetic poles serving as start points for the domin refining are produced in the steel sheet with linear strains or grooves, disorder of the 180°-magnetic domain structure might be apt to occur in areas away from the linear strains or grooves and the iron-loss reducing effect might not be obtained at a satisfactory level if the tension imparted to the steel sheet is weak. It is, therefore, preferable in the invention, that the insulation coating imparts a tension of not less than about 3.0 MPa to the steel sheet in the rolling direction.

The tension of the steel sheet is generally imparted by two kinds of coating; i.e., a forsterite coating formed on the steel sheet surface during final finishing annealing and an insulation tensile coating applied and baked after the final finishing annealing. The former forsterite serves as a binder between the metal part and the insulation tensile coating, and has the function of transmitting tension developed by the insulation tensile coating to the steel sheet. In the invention, presumably, adhesion between the forsterite coating and the metal part is increased with addition of Cr in the metal part, whereby the binding function is enhanced and acts to effectively reduce iron loss after the domain refining treatment. As for the latter insulation tensile coating, there is known a technique for mixing magnesium phosphate or aluminum phosphate, colloidal silica, etc., and then applying and baking a mixture. With such a tensile coating, a substance having a small thermal expansion coefficient is fixedly applied to the steel sheet surface in a state where the steel sheet after the final finishing annealing is heated to high temperature for thermal expansion. As a result, tension is imparted to the steel sheet at room temperature or thereabout. When that conventional type of insulation tensile coating is employed in the invention, a coating agent must be applied in amount ranging from about 2 to about 10 g/m$^2$ for each surface of the steel sheet after the application and baking, and then baked at annealing temperature in the range of about 700 to about 900° C. If the amount of the coating agent is less than about 2 g/m$^2$, a satisfactory level of tension would not be obtained due to an insufficient film thickness of the insulation tensile coating, and if it exceeds above about 10 g/m$^2$, the space factor would be deteriorated. Also, if the annealing temperature is lower than about 700° C., the steel sheet would not be thermally expanded to a sufficient extent in the step of fixedly applying the coating, and the tension imparted after cooling would be reduced. If the annealing temperature exceeds above about 900° C., the steel sheet would cause a creep during the annealing, and the shape and magnetic characteristics of the steel sheet would be deteriorated. Additionally, a coating layer made up of the forsterite and the insulation tensile coating preferably has a thickness in the range of about 0.5 to about 5.0 $\mu$m. If the coating thickness is less than about 0.5 $\mu$m, a satisfactory level of tension would not be obtained, and if it is larger than about 5.0 $\mu$m, the lamination factor would be reduced.

Furthermore, when a coating having a strong tension imparting effect, such as TiN, is employed, the film thickness and forming conditions of the coating are not necessarily limited to the above-mentioned ranges so long as a total value of tension imparted to the steel sheet, including the tension developed by the forsterite layer in direct contact with the metal part, is not lower than about 3 MPa.

(III) Magnetic Flux Density $B_8$ Satisfying Relationship of Formula (1) or (3)

$$B_8 \geqq (2.21-0.0604(\mathrm{Si})-0.0294(\mathrm{Cr}))\times 0.960 \quad (1)$$

(for linear strains)

$$B_8 \geqq (2.21-0.0604(\mathrm{Si})-0.0294(\mathrm{Cr}))\times 0.960-0.0030d \quad (3)$$

(for linear grooves)

$B_8$ representing magnetic flux density at a magnetizing force of 800 A/m has generally been employed as an index for a concentration of [001] orientation in the product. However, since $B_8$ is changed depending on a reduction in the saturated magnetic flux density caused by addition of an alloy element and the presence of grooves, it is impossible to, just based on $B_8$, precisely evaluate a concentration of the grain direction, which is an important factor for reducing iron loss, when the grooves are formed on the surface of the metal part containing various alloy elements, such as Cr. Therefore, the saturated magnetic flux density Bs is determined by putting the contents of Si and Cr in the following formula:

$$Bs=2.21-0.0604(\mathrm{Si})-0.0294(\mathrm{Cr})$$

In the case of carrying out the domain refining with linear strains, $B_8$ is required to satisfy the relationship of the above formula (1) meaning that $B_8$ is not less than about 96.0% of Bs. In the case of carrying out the domain refining with linear grooves, $B_8$ is required to satisfy the relationship of the above formula (3) that includes a correction term (−0.0030d (μm)) for the groove depth d. Also, when iron loss must be further reduced, $B_8$ is desirably not less than about 97.0% of Bs. Note that, in the case of carrying out the domain refining with linear strains, a reduction of $B_8$ due to the presence of linear strains is so small that the correction term taken into account in the case of carrying out the domain refining with linear grooves is negligible.

When fine grains are produced just below the grooves to enhance the domain refining effect, a reduction of $B_8$ primarily depends on the groove depth, and therefore the relationship of the above formula (3) must be satisfied.

(IV) Plurality of Linearly Extending Strains Being Induced Near Steel Sheet Surface at Angle of not Larger than about 45° (in each direction) Relative to Direction Perpendicular to Rolling Direction, or Plurality of Linearly Extending Grooves Being Formed in Steel Sheet Surface at Angle of not Larger than about 45° (in each direction) Relative to Direction Perpendicular to Rolling Direction The linear strains for the domain refining are induced, after flattening annealing, in the steel sheet by a locally heating process using a laser beam, a plasma flame, etc. or a mechanical process of contacting a needle or a rigid ball against the steel sheet surface so as to have components in a direction perpendicular to the rolling direction within a sheet plane (referred to as a "C-direction" hereinafter). It is thought that the linear strains induced near the steel sheet surface are usually imparted to not only the surface coating layer, but also the metal part. Thus, the linear strains are not limited to particular formations.

The linear grooves are formed in the steel sheet surface after cold rolling by, e.g., resist etching or impression using a gear-shaped roll so as to have components in the C-direction. For example, various annealing and coating processes may be performed after forming the grooves subsequent to cold rolling, or the grooves may be formed after forming a surface coating. If the linear strains or grooves are not within the angle range of not larger than about 45° (in each direction, clockwise or counterclockwise) relative to the direction perpendicular to the rolling direction, the iron loss reducing effect would not be obtained at a satisfactory level because of not only a reduction in the number of magnetic poles produced, but also an increase in hysteresis loss resulting from obstruction against movement of domain walls. For that reason, the linear strains or grooves must be extended at an angle of not larger than about 45° (in each direction) relative to the direction perpendicular to the rolling direction.

Note that the term "linear strains or grooves" used herein includes strains or grooves that are linearly continued in the form of dots, in addition to literally linear strains or grooves.

(V) Array Interval D of Linear Strains or Grooves Satisfying Relationship of Formula (2) or (4)

$$3+5(\mathrm{Cr})\leqq D\leqq 11+5(\mathrm{Cr})\ \text{(for linear strains)} \quad (2)$$

$$1+5(\mathrm{Cr})\leqq D\leqq 8+5(\mathrm{Cr})\ \text{(for linear grooves)} \quad (4)$$

The invention is featured in changing the interval D, at which the linear strains or grooves are formed in the array for the domain refining depending on the Cr content. As described above, both an increase in the Cr content and implementation of the domain refining treatment have an action to reduce permeability. Therefore, if those factors are each intensified at the same time, permeability would be significantly reduced and hysteresis loss would be increased. For that reason, the interval of the linear strains or grooves for the domain refining must properly be adjusted corresponding to an increase in the Cr content. Also, since the amount and distribution of magnetic poles produced differ between the case of carrying out the domain refining with linear strains and the case of carrying out the domain refining with linear strains, the proper range of the interval D is different in both the cases.

If the interval D of the linear strains is smaller than 3+5(Cr) or if the interval D of the linear grooves is smaller than 1+5(Cr), the amount of magnetic poles produced in wall surfaces of the linear strains or grooves would be excessively increased and permeability would be reduced. Conversely, if the interval D of the linear strains is larger than 11+5(Cr) or if the interval D of the linear grooves is larger than 8+5(Cr), the iron loss reducing effect would not be obtained at a satisfactory level. Therefore, the array intervals D of the linear strains or grooves were limited to the respective ranges given by the above formulae (2) and (4).

In pursuit of achieving the iron loss reducing effect at a higher level, as seen from FIGS. 2 and 3, the relationships of $5+5(\mathrm{Cr})\leqq D\leqq 9+5(\mathrm{Cr})$ and $0.15\leqq(\mathrm{Cr})\leqq 0.70$ are preferably satisfied in the case of carrying out the domain refining with linear strains, and the relationships of $1+5(\mathrm{Cr})\leqq D\leqq 5+5(\mathrm{Cr})$ and $0.15\leqq(\mathrm{Cr})\leqq 0.70$ are preferably satisfied in the case of carrying out the domain refining with linear grooves. Note that the interval of the linear strains or grooves means the shortest distance between adjacent strains or grooves.

When fine grains are formed just below the linear grooves, it is thought that reductions in both the domain refining effect and permeability primarily depend on the number of magnetic poles produced in wall surfaces of the grooves. Therefore, the interval D of the linear grooves in such a case is just required to satisfy the range given by the above formula (4). Also, the interval D of the linear strains or grooves is not always required to be constant. In that case, it is required that a mean value of the intervals D satisfies the range given by the above formula (2) or (4). (VI) Groove Depth d Being about 1.5 to about 15% of Sheet Thickness when Carrying out Domain Refining with Linear Grooves (preferable)

Preferably, the depth d of the linear grooves is properly controlled to realize the proper conditions for the domain refining. If the depth d of the linear grooves is smaller than about 1.5% of the sheet thickness, a proportion of the number of magnetic poles produced in wall surfaces of the grooves to the total sheet thickness might be reduced, and the iron loss reducing effect might not be obtained at a satisfactory level. Conversely, if the groove depth d exceeds above about 15% of the sheet thickness, the number of magnetic poles produced might be excessive and permeability might be deteriorated, thus giving rise to an increase in hysteresis loss and hence an increase in iron loss. When carrying out the domain refining with linear grooves, therefore, the groove depth d is preferably set so as to fall in the range of about 1.5 to about 15% of the sheet thickness. Note that "d" represents a value of the groove measured from the steel sheet surface including the coating.

(VII) Of Layers Forming Surface Coating, Layer in Contact with Metal Part Being Primarily Made of Forsterite (Preferable)

The reason why iron loss after the domain refining is reduced in the invention by addition of Cr in the metal part is not yet fully clarified, but presumably resides in that the added Cr acts to make denser the forsterite coating, which is formed on the metal part surface in the step of final finishing annealing, and disorder of the magnetic domain structure is suppressed in very close areas around the linear strains or grooves formed for the domain refining. It is, therefore, preferable that, of layers (or a layer in case of a single layer) forming the surface coating, a layer in contact with the metal part be primarily made of forsterite (not less than about 80% by volume ratio).

(VIII) Secondary Recrystallized Grains Having Mean Length of not Less than about 30 mm in Rolling Direction (Preferable)

In ordinary grain oriented electrical steel sheets, since iron loss is reduced with the domain refining effect developed at the grain boundary, it is advantageous from the standpoint of reducing iron loss that the secondary recrystallized grains have smaller sizes. In the invention, however, iron loss can be much reduced in comparison with conventional methods by carrying out the domain refining treatment depending on the Cr content, and hence the grain boundary is no longer required to be kept fine. Because the component of the grain boundary in the C-direction causes a reduction in permeability, it is rather advantageous to reduce the density of the grain boundary in the C-direction from the standpoint of further reducing iron loss generated in the grain oriented electrical steel sheet of the present invention. Such an effect becomes significant when the secondary recrystallized grains have a mean length of not less than about 30 mm in the rolling direction. Therefore, the mean length of the secondary recrystallized grains in the rolling direction is preferably not less than about 30 mm.

Herein, the mean length of the secondary recrystallized grains in the rolling direction are measured by selecting an area of about 200 mm in the rolling direction and about 100 mm in the C-direction, drawing in the area a plurality of segments (lines) parallel to the rolling direction at an interval of about 5 mm in the C-direction, determining the number of intersects at which the segments cross the grain boundaries, and dividing the sum of lengths of the segments by the total number of intersects with the grain boundaries.

A description is now made of the reasons for setting limitations in the method of producing the grain oriented electrical steel sheet.

(i) Composition of Steel Slab

C: about 0.01 to about 0.10 mass %

C is an element useful for improving a hot band structure (or microstructure of hot-rolled sheet) by utilizing transformation and for generating nuclei of recrystallized grains in the Goss orientation. The content of C is required to be not less than about 0.01 mass %, but if the C content exceeds above about 0.10 mass %, a failure in decarburization would occur during decarburization annealing. Therefore, the C content was limited to the range of about 0.01 to about 0.10 mass %.

Si: about 2.5 to about 5.0 mass %

Si is an element required for increasing electrical resistance to reduce iron loss, stabilizing the α phase of iron, and enabling heat treatment to be performed at high temperature. At least about 2.5 mass % is required, but if the Si content exceeds above about 5.0 mass %, it would be difficult to perform cold rolling. Therefore, the Si content was limited to the range of about 2.5 to about 5.0 mass %.

Mn: about 0.03 to about 0.20 mass %

Mn effectively contributes to improving hot brittleness of steel. In addition, when S and Se are mixed, Mn forms precipitates, such as MnS and MnSe, to develop the function as an inhibitor. If the Mn content is less than about 0.03 mass %, the above effect would be insufficient. Conversely, if it exceeds above about 0.20 mass %, the sizes of precipitates, such as MnSe, would be too increased to develop the effect as an inhibitor. Therefore, the Mn content was limited to the range of about 0.03 to about 0.20 mass %.

One or two selected from sol. Al: about 0.015 to about 0.035 mass % and B: about 0.0010 to about 0.0150 mass %

Al and B are each a useful element binding with N to form AlN or BN and providing a second dispersed phase in steel to act as an inhibitor (such an element added to form an inhibitor is called an inhibitor element). In the present invention, one or two selected from Al and B must be contained in the steel slab.

However, if the Al content does not reach about 0.015 mass %, a sufficient amount of precipitates would not be ensured. Conversely, if Al is added in excess of about 0.035 mass %, precipitated AlN would be coarse and would no longer act as an inhibitor. Therefore, the sol. Al content was limited to the range of about 0.015 to about 0.035 mass %.

Also, if the B content does not reach about 0.0010 mass %, a sufficient amount of precipitated BN would not be ensured. Conversely, if B is added in excess of about 0.0150 mass %, the precipitated BN would be coarse grains and would no longer act as an inhibitor. Therefore, the B content was limited to the range of about 0.0010 to about 0.0150 mass %.

N: about 0.0015 to about 0.0130 mass %

N is an element required for forming AlN and BN when added in steel together with Al and B. However, if the N content is lower than about 0.0015 mass %, amounts of precipitated AlN and BN would be insufficient and the inhibition effect would not be obtained at a satisfactory level. If N is added in excess of about 0.0130 mass %, a blister or the like would occur in the slab when it is heated. Therefore, the N content was limited to the range of about 0.0015 to about 0.0130 mass %.

One or two selected from S and Se in total content of about 0.010 to about 0.030 mass %

Se and S are each a useful element binding with Mn or Cu to form MnSe, MnS, $Cu_{2-x}Se$ or $Cu_{2-x}S$ and providing a second dispersed phase in steel to act as an inhibitor. If the total content of Se and/or S does not reach about 0.010 mass %, the effect resulting from addition of Se and/or S would be insufficient. Conversely, if the total content exceeds above about 0.030 mass %, solid solution of the slab would be incomplete when heated, and in addition a defect would be caused in the product surface. In any of sole or combined addition, therefore, the total content of one or two selected from S and Se was limited to the range of about 0.010 to about 0.030 mass %.

Cr: about 0.05 to about 1.0 mass %

As mentioned above in connection with Cr contained in the metal part, Cr can be regarded as having actions not only to increase electrical resistivity, thereby reducing eddy current loss, but also to enhance adhesion between the metal part and forsterite, thereby contributing to reducing iron loss of the steel sheet subjected to the domain refining treatment.

In order to obtain those effects, Cr must be contained in the steel slab in amount of not less than about 0.05 mass %. Conversely, if Cr is added in excess of about 1.0 mass %, there would arise a risk in points of changing behavior of precipitation of an inhibitor, such as AlN and BN, and causing a deterioration in magnetic characteristics. Therefore, the Cr content was limited to the range of about 0.05 to about 1.0 mass %. Note that the amount of Cr added in the slab is substantially equal to the Cr content in the metal part of the product.

Although it is just required in the invention to limit the foregoing ingredients as described above, one or more may be selected from among Sb, Cu, Sn, Ni and Ge, other than Bi, as other ingredients serving as inhibitors, and may be added alone or in the combined form. In addition, any of still other known inhibitor elements, such as Te, P, Zn and In, may also be added.

Bi: about 0.001 to about 0.10 mass %

Bi has actions to intensify a power for inhibiting growth of normal grains due to segregation at the grain boundary, to increase a concentration of Goss orientation after secondary recrystallization, and accelerate growth of secondary recrystallized grains in the rolling direction. The grain oriented electrical steel sheet of the invention is featured in adding Cr in the metal part of the product and setting the proper condition for the domain refining depending on the Cr content. Additionally, iron loss can more effectively be reduced by increasing a concentration of Goss orientation and at the same time accelerating growth of the secondary recrystallized grains in the rolling direction. In order to obtain those effects, Bi is preferably added in the steel slab. If the amount of Bi in the slab is lower than about 0.001 mass %, the effect of inhibiting growth of normal grains would be insufficient. Conversely, if Bi is added in excess of about 0.10 mass %, there would arise a risk that the forsterite coating is not obtained in a satisfactory thickness and a difficulty is caused in reducing iron loss. When adding Bi in the steel slab, the amount of Bi added is preferably set to be in the range of about 0.001 to about 0.10 mass %. Additionally, because of a certain amount of Bi being disappeared from the steel during final finishing annealing, when Bi is added in the steel slab in the range of about 0.001 to about 0.10 mass %, the Bi content in the metal part of the product is reduced to the range of about 0.0005 to about 0.08 mass %.

Other ingredients (Cu, Sb, Sn, Ni and Ge)

Cu is a useful element forming $Cu_{2-x}Se$ or $Cu_{2-x}S$ in steel and providing a second dispersed phase in the steel to act as an inhibitor. Cu contributes to stabilizing secondary recrystallization.

Sb and Sn have an action to secondarily intensify the inhibitor function due to segregation at the grain boundary, and to stabilize secondary recrystallization.

Ni and Ge also have an action to intensify the inhibitor function and stabilize secondary recrystallization.

For causing those additive elements to develop the inhibitor function, it is preferable that the Cu content be in the range of about 0.05 to about 0.20 mass %, the Sb content be in the range of about 0.005 to about 0.10 mass %, the Sn content be in the range of about 0.05 to about 0.20 mass %, and each of the Ni and Ge contents be in the range of about 0.005 to about 1.30 mass %. The reason is that if those elements are added in amounts less than the respective ranges, a sufficient inhibiting power would not be obtained, and if those elements are added in excess of the respective ranges, there would arise a risk that cracks are more likely to occur during hot rolling and cold rolling, thus resulting in the reduced yield of products.

As other inhibitor elements, one or more selected from Te: about 0.001 to about 0.05 mass %, P: about 0.005 to about 0.05 mass %, Zn: about 0.0002 to about 0.005 mass %, and In: about 0.002 to about 0.1 mass % may be added.

Of the elements mentioned above, Mn, Si, Cr, Sb, Sn, Cu, Mo, Ge and Ni are contained in the slab and the product (metal part) at essentially the same ratios. The amount of C is reduced to about 0.0050 mass % or below primarily through the decarburization annealing. Also, after the final annealing, the amount of N is reduced to about 0.0050 mass % or below, and the amount of 0 is reduced to about 0.0050 mass %. Further, although the inhibitor elements are preferably reduced to almost zero during the final finishing annealing, some elements may remain in small amounts; i.e., Se: not more than about 0.0050 mass %, S: not more than about 0.0050 mass %, Al: not more than about 0.0050 mass %, B: not more than about 0.0030 mass %, P: not more than about 0.05 mass %, and Zn: not more than about 0.0005 mass %. Note that the Te and In contents are less reduced during the final finishing annealing.

(ii) Production Conditions

The steel slab having the composition adjusted as described above is heated to high temperature of not lower than about 1350° C., or be subject to hot rolling before the temperature of the cast slab decreases lower then about 1350° C. in case of Hot Charge or Direct Charge, for solid solution of the inhibitor ingredient. However, when the inhibitor is intensified in a subsequent step by, e.g., nitriding, the heating temperature may be not higher than about 1280° C.

Thereafter, the slab is subjected to hot rolling and then to a combination of annealing and cold rolling, thereby obtaining a steel sheet having a final thickness. After carrying out decarburization annealing and final finishing annealing in order, an insulation coating is formed on the steel sheet by applying and baking an insulation tensile coating agent, whereby a product is obtained.

In the above process, the steel sheet having the final thickness is obtained by 1) a method of, after the hot rolling, annealing a hot-rolled sheet, and then carrying out cold rolling two or more times, including intermediate annealing one or more times, until the final sheet thickness is obtained, 2) a method of, after the hot rolling, annealing a hot-rolled sheet, and then carrying out cold rolling once, until the final sheet thickness is obtained, and 3) a method of, after the hot rolling, carrying out cold rolling two or more times, including intermediate annealing one or more times, without the hot band annealing (annealing a hot rolled sheet), until the final sheet thickness is obtained. The invention may use any of those methods.

Also, carrying out a process in which an oxidizing annealing atmosphere is created in the step of hot-rolled sheet annealing and intermediate annealing for slight decarburization of a surface layer, or a process in which a cooling step after the annealing is performed as quenching to increase the amount of solid solution C in steel, or a process in which, after the quenching, the sheet is held at comparatively low temperature to precipitate fine carbides in steel, is effective to improve magnetic characteristics of the product. Accordingly, any of those processes may be carried out as required.

Furthermore, magnetic characteristics of the product can also be advantageously improved by carrying out warm rolling at temperature of about 100 to about 300° C. in place of the cold rolling, or aging between passes. Likewise, such a process may be carried out as required.

The nitriding technique for causing N to be contained in steel in amount of not more than about 300 ppm during a period until the start of secondary recrystallization after annealing for decarburization and primary recrystallization is, as well known in the art, also effective to enhance the power for inhibiting primary grain growth. Applying that known technique to the invention enables a product to be produced with more superior coating characteristics and magnetic characteristics.

After the decarburization annealing, an annealing separator is applied to the steel sheet, which is then subjected to the final finishing annealing. Subsequently, an insulation coating agent is applied and flattening annealing is carried out for baking and flattening, whereby an insulation coating is formed and a product is obtained. In the above process, it is preferable the final finishing annealing is performed at maximum attainment temperature of about 1130 to about 1300° C. for about about 0.5 to about 50 hours, and the flattening annealing is performed at about 700 to about 900° C. for about 5 to about 300 seconds.

When the non-heatproof domain refining treatment is carried out by inducing linear strains, the strains are induced in the steel sheet after the flattening annealing in the above-described process by linearly irradiating a laser beam or a plasma flame at an angle of not larger than about 45° (in each direction) relative to the direction perpendicular to the rolling direction of the steel sheet (C-direction). The array interval D of the linear strains is properly set depending on the Cr content.

Also, when the heatproof domain refining treatment is carried out by forming linear grooves, the grooves are formed in the steel sheet after the final cold rolling (not limited to immediately after)in the above-described process by, e.g., resist etching or impression using a gear-shaped roll. As with the above case, the grooves are formed at an angle of not larger than about 45° (in each direction) relative to the C-direction, and the array interval D of the linear grooves is properly set depending on the Cr content.

Soaking Temperature T in Annealing before Final Cold Rolling being Set to Range Given by Formula (5)

$$1000-200(\mathrm{Cr}) \leqq T \leqq 1150-200(\mathrm{Cr}) \quad (5)$$

In the invention, a high concentration of Goss orientation must be achieved by satisfying the above-described relationship of the formula (1) or (3) for the purpose of realizing a steel sheet of low iron loss. To that end, a proper level of inhibitor intensity must be obtained after annealing before the final cold rolling.

Herein, the term "annealing before the final cold rolling" means the hot band annealing when the final sheet thickness is obtained by the above method 2), and means the last intermediate annealing when the final sheet thickness is obtained by the above method 1) or 3). The "last intermediate annealing" does not include, for example, softening and aging at temperatures not higher than the recrystallization temperature.

Generally, if the temperature in the annealing before the final cold rolling is too high, a precipitate dispersed phase (inhibitor) of AlN, BN, etc. would become coarse, and the grain size in the steel sheet after the decarburization annealing would be increased. On the other hand, if that annealing temperature is too low, the inhibitor would excessively be intensified, and the grain size in the steel sheet after the decarburization annealing would be too small. Hence, urging forces in grain growth would be excessively increased and growth of the secondary recrystallized grains in an undesired grain orientation would be promoted, thus resulting in deterioration of magnetic characteristics.

When Cr is added as one ingredient of the base material, the proper temperature before the final finishing differs from that resulting when Cr is not added, as plotted in FIG. 4. The reason is presumably in that precipitation behavior of AlN and BN is changed depending on addition of Cr in steel.

If the soaking temperature (° C.) in the annealing before the final cold rolling is lower than the value of 1000–200 (Cr), the inhibitor intensity would be too strong and excessive driving forces in secondary-grain growth would be developed at low temperature. Hence, the secondary recrystallized grains would be generated in an undesired grain orientation. Conversely, if the soaking temperature is higher than the value of 1150–200(Cr), the inhibitor intensity would be insufficient in the steel sheet after the decarburization annealing, and the sizes of the primary recrystallized grains would be increased. Hence, the secondary recrystallized grains would not be grown and magnetic characteristics would be deteriorated. In the invention, for those reasons, the soaking temperature T in the annealing before the final cold rolling was limited to the range given by the formula (5).

The soaking time in the annealing before the final cold rolling is preferably in the range of about 10 to about 300 seconds on condition the above temperature range is satisfied. If the soaking time is shorter than about 10 seconds, the primary recrystallized grains would not sufficiently be grown and the grain size before the final cold rolling would be too small, thus resulting in deterioration of magnetic characteristics. Conversely, if the soaking time exceeds about 300 seconds, the primary recrystallized grains would excessively be grown and the grain size would be too large, thus resulting in deterioration of magnetic characteristics after the final finishing annealing.

It is to be noted that the above description merely discloses one preferred embodiment of the invention, and a variety of modifications can be made without departing from the scope of the invention defined in claims.

EXAMPLES

Example 1

A steel slab was prepared which contained C: 0.06 mass %, Si: 3.3 mass %, Mn: 0.07 mass %, P: 0.003 mass %, S: 0.003 mass %, Al: 0.023 mass %, Se: 0.020 mass %, Sb: 0.030 mass %, Cu: 0.05 mass %, N: 0.0082 mass %, and Cr: 0.40 mass %, the balance being primarily iron. The steel slab was loaded in a gas heating furnace and heated to 1230° C. After holding the slab to stand in that condition for 60 minutes, the slab was further heated to 1400° C. for 30 minutes by induction heating, and then subjected to hot rolling to obtain a hot rolled sheet having a thickness of 2.5 mm. Thereafter, the hot rolled sheet was subjected to annealing of 1000° C.×1 minute. After pickling of the annealed sheet, a steel sheet having a thickness of 1.6 mm was obtained by primary cold rolling. The cold rolled sheet was then subjected to intermediate annealing (annealing before final cold rolling) at 1000° C. for 1 minute. After pickling, the steel sheet was subjected to secondary cold rolling at a maximum attainment temperature of 220° C. to obtain a final sheet thickness of 0.23 mm. The steel sheet was then subjected to decarburization annealing of 850° C.×100 seconds in an atmosphere with an oxidizing ability of $P(H_2O)/P(H_2)=0.45$ in the soaking step. Subsequently, the steel sheet was coiled into the form of a coil after coating an annealing separator, which contained MgO as a main ingredient and 5% of $TiO_2$, in an amount of 7 g/m$^2$ for each surface of the steel sheet. Thereafter, the steel sheet was subjected to final finishing annealing by raising the temperature from 700 to 1050° C. at a constant rate of 20° C./h and holding the sheet at 1200° C. for 10 hours. Subsequently, an insulation coating was formed by applying an insulation tensile coating agent, which contained as a main ingredient magnesium phosphate and colloidal silica, in amount of 5 g/m$^2$ for each surface of the steel sheet. After flattening annealing, linear strains were induced in the steel sheet by irradiating a plasma flame at an each interval shown in Table 3, given below, and at an angle of 10° relative to the C-direction.

An Epstein test piece of about 500 g was sampled from each product obtained by the above-described process, and iron loss $W_{17/50}$ of the test piece was measured in accordance with the Epstein test procedure. Also, after removing the insulation coating on one side, a tension in the rolling direction was measured based on bowing of the steel sheet. As a result, tensions of all the steel sheets were in the range of 4.5 to 5.5 MPa. Additionally, the obtained product had metal part composition of C: 0.0010 mass %, P: 0.0005 mass %, S: 0.0005 mass %, Al: 0.0003 mass %, Se: 0.0001 mass %, and N: 0.0005 mass %. The contents of Si, Mn, Sb, Cu and Cr in the metal part were the same as those in the slab.

TABLE 3

| No. | Linear strain interval (mm) | $W_{17/50}$ (W/kg) | Remarks |
|---|---|---|---|
| 1 | 3 | 0.732 | Comparative example |
| 2 | 5 | 0.689 | Inventive example |
| 3 | 7 | 0.652 | Inventive example |
| 4 | 9 | 0.631 | Inventive example |
| 5 | 11 | 0.645 | Inventive example |
| 6 | 13 | 0.684 | Inventive example |
| 7 | 15 | 0.735 | Comparative examaple |
| 8 | 17 | 0.763 | Comparative example |

As seen from the results of Table 3, by producing steel sheets according to the method of the invention, products having very low iron loss of $W_{17/50} \leqq 0.70$ W/kg were obtained.

Example 2

Nine kinds of steel slabs were prepared which contained C: 0.06 mass %, Si: 3.3 mass %, Mn: 0.07 mass %, P: 0.003 mass %, S: 0.003 mass %, Al: 0.023 mass %, Se: 0.020 mass %, Sb: 0.030 mass %, Cu: 0.05 mass %, N: 0.008 mass %, and Cr in the range of 0 to 1.3 mass %, as shown in Table 4, the balance being primarily iron. Each steel slab was loaded in a gas heating furnace and heated to 1230° C. After holding the slab to stand in that condition for 60 minutes, the slab was further heated to 1400° C. for 30 minutes by induction heating, and then subjected to hot rolling to obtain a hot rolled sheet having a thickness of 2.5 mm. Thereafter, the hot rolled sheet was subjected to annealing of 900° C.×1 minute. After pickling of the annealed sheet, a steel sheet having a thickness of 1.6 mm was obtained by primary cold rolling. The cold rolled sheet was then subjected to intermediate annealing (annealing before final cold rolling) at 1000° C. for 1 minute. After pickling, the steel sheet was subjected to secondary cold rolling at a maximum attainment temperature of 220° C. to obtain a final sheet thickness of 0.23 mm. Thereafter, grooves each having a depth of 20 μm and a width of 100 μm were formed in the steel sheet by resist etching at an array interval of 5 mm, the grooves linearly extending at an angle of 5° relative to the C-direction.

The steel sheet was then subjected to decarburization annealing of 850° C.×100 seconds in an atmosphere with an oxidizing ability of $P(H_2O)/P(H_2)=0.45$ in the soaking step. Subsequently, the steel sheet was coiled into the form of a coil after coating with an annealing separator, which contained MgO as a main ingredient, $TiO_2$: 5 mass % and $Sr(OH)_2.8H_2O$: 2 mass %, in amount of 6 g/m$^2$ for each surface of the steel sheet. Thereafter, the steel sheet was subjected to final finishing annealing by raising the temperature from 700 to 850° C. at a constant rate of 20° C./h and holding the sheet at 850° C. for 20 hours, and by further raising the temperature from 850 to 1150° C. at a constant rate of 15° C./h and holding the sheet at 1200° C. for 10 hours. Subsequently, an insulation coating was formed by applying an insulation tensile coating agent, which contained as a main ingredient magnesium phosphate and colloidal silica, in an amount of 5 g/m$^2$ for each surface of the steel sheet. A product was thereby obtained. Tensions imparted from the coatings to metal part of the products were in the range of 4.5 to 5.5 MPa. Additionally, each obtained product had a metal part composition of C: 0.0009 mass %, P:<0.0004 mass %, S:<0.0004 mass %, Al: 0.0003 mass %, Se:<0.0001 mass %, and N: 0.0003 mass %. The contents of Si, Mn, Sb, Cu and Cr in the metal part were the same as those in the slab.

An Epstein test piece of about 500 g was sampled from each product obtained by the above-described process, and iron loss $W_{17/50}$ and magnetic flux density $B_8$ of the test piece were measured in accordance with the Epstein test procedure.

TABLE 4

| Symbol | Amount of Cr added (mass %) | 1000–200 (Cr) (° C.) | Intermediate annealing temperature (° C.) | 1150–200 (Cr) (° C.) | $B_0$ *1 (T) | $B_8$ (T) | $W_{17/50}$ (W/kg) | Remarks |
|---|---|---|---|---|---|---|---|---|
| 4A | 0.00 | 1000 | 1000 | 1150 | 1.870 | 1.882 | 0.743 | Comparative example |
| 4B | 0.03 | 994 | | 1144 | 1.869 | 1.881 | 0.739 | Comparative example |
| 4C | 0.06 | 988 | | 1138 | 1.869 | 1.879 | 0.685 | Inventive example |
| 4D | 0.12 | 976 | | 1126 | 1.867 | 1.882 | 0.669 | Inventive example |
| 4E | 0.24 | 952 | | 1102 | 1.863 | 1.879 | 0.652 | Inventive example |
| 4F | 0.51 | 898 | | 1048 | 1.856 | 1.877 | 0.643 | Inventive example |
| 4G | 0.80 | 840 | | 990 | 1.848 | 1.832 | 0.779 | Comparative example |
| 4H | 1.00 | 800 | | 950 | 1.842 | 1.831 | 0.821 | Comparative example |
| 4I | 1.30 | 740 | | 890 | 1.834 | 1.822 | 0.926 | Comparative example |

*1 $B_0 = (2.21 - 0.0604(Si) - 0.0294(Cr)) \times 0.960 - 0.0030d$

As seen from the results of Table 4, by producing steel sheets according to the method of the invention, products having very low iron loss of $W_{17/50} \leqq 0.70$ W/kg are obtained.

Example 3

Twenty-four kinds of steel slabs were prepared which contained compositions shown in Table 5 given below, the balance being primarily iron. Each steel slab was loaded in a gas heating furnace and heated to 1230° C. After holding the slab to stand in that condition for 60 minutes, the slab was further heated to 1400° C. for 30 minutes by induction heating, and then subjected to hot rolling to obtain a hot rolled sheet having a thickness of 2.5 mm. Thereafter, the hot rolled sheet was subjected to annealing of 900° C.×1 minute. After pickling the annealed sheet, a steel sheet having a thickness of 1.6 mm was obtained by primary cold rolling. The cold rolled sheet was then subjected to intermediate annealing (annealing before final cold rolling) at 1000° C. for 1 minute. After pickling, the steel sheet was subjected to secondary cold rolling at a maximum attainment temperature of 220° C. to obtain a final sheet thickness of 0.23 mm. Thereafter, grooves each having a depth of 15 μm and a width of 60 μm were formed in the steel sheet by resist etching at an array interval of 7 mm, the grooves linearly extending at an angle of 10° relative to the C-direction.

The steel sheet was then subjected to decarburization annealing of 850° C.×100 seconds in an atmosphere with an oxidizing ability of $P(H_2O)/P(H_2)=0.45$ in the soaking step. Subsequently, the steel sheet was coiled into the form of a coil after coating with an annealing separator, which contained MgO as a main ingredient, $TiO_2$: 5 mass % and $Sr(OH)_2.8H_2O$: 2 mass %, in an amount of 6 g/m$^2$ for each surface of the steel sheet. Thereafter, the steel sheet was subjected to final finishing annealing by raising the temperature from 700 to 850° C. at a constant rate of 20° C./h and holding the sheet at 850° C. for 20 hours, and by further raising the temperature from 850 to 1150° C. at a constant rate of 15° C./h and holding the sheet at 1200° C. for 10 hours. Subsequently, an insulation coating was formed by applying an insulation tensile coating agent, which contained as a main ingredient magnesium phosphate and colloidal silica, in an amount of 5 g/m$^2$ for each surface of the steel sheet. A product was thereby obtained. Tension imparted from the coatings to the metal part of the products were in the range of 4.5 to 5.5 Mpa.

An Epstein test piece of about 500 g was sampled from each product obtained by the above-described process, and iron loss $W_{17/50}$ and magnetic flux density $B_8$ of the test piece were measured in accordance with the Epstein test procedure. Measured results are listed in Table 6, below, along with the Bi content in the metal part of the product. Additionally, the contents of C, P, S, Al, Se, N and B in the metal part of the product are listed in Table 7 below. The contents of other ingredients in the metal part were the same as those listed in Table 5.

TABLE 5

| | Slab composition (mass %) | | | | | | | | | | | | | | | | | Intermediate annealing temperature |
|---|---|---|---|---|---|---|---|---|---|---|---|---|---|---|---|---|---|---|
| Symbol | C | Si | Mn | P | S | Al | Se | Ni | Bi | Sb | Cu | Sn | Cr | Mo | N | B | Ge | (° C.) |
| 5A | 0.07 | 3.3 | 0.07 | 0.003 | 0.003 | 0.023 | 0.015 | tr | tr | 0.030 | tr | tr | 0.01 | 0.015 | 0.0083 | tr | tr | 1100 |
| 5B | 0.07 | 3.3 | 0.07 | 0.003 | 0.003 | 0.023 | 0.015 | tr | 0.024 | 0.030 | tr | tr | 0.01 | 0.015 | 0.0084 | tr | tr | 1100 |
| 5C | 0.07 | 3.3 | 0.07 | 0.003 | 0.003 | 0.024 | 0.016 | tr | 0.0008 | 0.031 | tr | tr | 0.35 | 0.014 | 0.0084 | tr | tr | 1050 |
| 5D | 0.07 | 3.3 | 0.07 | 0.003 | 0.003 | 0.023 | 0.014 | tr | 0.0012 | 0.032 | tr | tr | 0.35 | 0.015 | 0.0082 | tr | 0.015 | 1050 |
| 5E | 0.07 | 3.3 | 0.07 | 0.003 | 0.003 | 0.023 | 0.014 | tr | 0.007 | 0.032 | tr | 0.07 | 0.36 | 0.014 | 0.0083 | tr | tr | 1050 |
| 5F | 0.07 | 3.3 | 0.07 | 0.003 | 0.003 | 0.025 | 0.014 | 0.12 | 0.021 | 0.030 | tr | tr | 0.36 | 0.014 | 0.0084 | tr | tr | 1050 |
| 5G | 0.07 | 3.3 | 0.07 | 0.003 | 0.003 | 0.023 | 0.015 | tr | 0.062 | 0.031 | 0.15 | tr | 0.36 | 0.014 | 0.0084 | tr | tr | 1050 |
| 5H | 0.07 | 3.3 | 0.07 | 0.003 | 0.014 | 0.022 | tr | tr | tr | tr | 0.15 | 0.12 | 0.01 | tr | 0.0083 | tr | tr | 1100 |
| 5I | 0.07 | 3.3 | 0.07 | 0.003 | 0.013 | 0.023 | tr | tr | 0.006 | tr | 0.15 | 0.12 | 0.52 | tr | 0.0082 | tr | tr | 1000 |
| 5J | 0.07 | 3.3 | 0.07 | 0.003 | 0.013 | 0.022 | tr | tr | 0.036 | tr | 0.15 | 0.12 | 0.52 | tr | 0.0083 | tr | tr | 1000 |
| 5K | 0.07 | 3.3 | 0.07 | 0.003 | 0.015 | 0.022 | tr | tr | 0.052 | tr | 0.15 | 0.12 | 0.52 | tr | 0.0084 | tr | tr | 1000 |
| 5L | 0.07 | 3.3 | 0.07 | 0.003 | 0.012 | 0.024 | tr | tr | 0.11 | tr | 0.15 | 0.12 | 0.52 | tr | 0.0084 | tr | tr | 1000 |
| 5M | 0.07 | 3.3 | 0.07 | 0.003 | 0.003 | 0.005 | 0.017 | 0.10 | 0.015 | 0.031 | 0.12 | tr | 0.01 | 0.015 | 0.0082 | 0.0035 | tr | 1100 |
| 5N | 0.07 | 3.3 | 0.07 | 0.003 | 0.003 | 0.007 | 0.018 | 0.10 | 0.022 | 0.033 | 0.12 | tr | 0.25 | 0.015 | 0.0080 | 0.0037 | tr | 1050 |
| 5O | 0.07 | 3.3 | 0.07 | 0.002 | 0.002 | 0.006 | 0.017 | 0.10 | 0.032 | 0.033 | 0.12 | tr | 0.26 | 0.015 | 0.0082 | 0.0035 | tr | 1050 |
| 5P | 0.07 | 3.3 | 0.07 | 0.002 | 0.003 | 0.005 | 0.019 | tr | 0.025 | 0.032 | 0.11 | tr | 0.25 | 0.015 | 0.0081 | 0.0042 | 0.025 | 1050 |
| 5Q | 0.07 | 3.3 | 0.07 | 0.002 | 0.015 | 0.009 | tr | tr | 0.045 | 0.034 | 0.11 | tr | 0.62 | 0.015 | 0.0083 | 0.0044 | tr | 1000 |
| 5R | 0.07 | 3.3 | 0.07 | 0.002 | 0.002 | 0.020 | 0.019 | tr | tr | 0.035 | 0.10 | tr | 0.30 | 0.014 | 0.0081 | 0.0029 | tr | 950 |
| 5S | 0.07 | 3.3 | 0.07 | 0.002 | 0.002 | 0.021 | 0.020 | tr | 0.002 | 0.032 | 0.10 | tr | 0.30 | 0.014 | 0.0075 | 0.0030 | tr | 950 |
| 5T | 0.07 | 3.3 | 0.07 | 0.002 | 0.002 | 0.019 | 0.020 | 0.10 | 0.018 | 0.035 | 0.10 | tr | 0.30 | 0.014 | 0.0080 | 0.0033 | tr | 950 |
| 5U | 0.07 | 3.3 | 0.07 | 0.002 | 0.002 | 0.022 | tr | tr | 0.005 | tr | 0.15 | 0.15 | 0.30 | tr | 0.0081 | 0.0035 | tr | 950 |
| 5V | 0.07 | 3.3 | 0.07 | 0.002 | 0.002 | 0.022 | tr | tr | 0.025 | tr | 0.15 | 0.15 | 0.30 | tr | 0.0079 | 0.0032 | tr | 950 |
| 5W | 0.07 | 3.3 | 0.07 | 0.002 | 0.002 | 0.020 | 0.019 | tr | tr | tr | tr | tr | 0.30 | tr | 0.0080 | 0.0030 | tr | 950 |
| 5X | 0.07 | 3.3 | 0.07 | 0.002 | 0.002 | 0.019 | 0.020 | tr | 0.018 | tr | tr | tr | 0.30 | tr | 0.0080 | 0.0032 | tr | 950 |

TABLE 6

| Symbol | Bi amount in metal part (mass %) | Mean length of secondary recrystalized grains in rolling direction (mm) | $B_0$ (T) | $B_8$ (T) | $W_{17/50}$ (W/kg) | Remarks |
|---|---|---|---|---|---|---|
| 5A | 0 | 11 | 1.885 | 1.905 | 0.755 | Comparative example |
| 5B | 0.019 | 45 | 1.885 | 1.932 | 0.748 | Comparative example |
| 5C | 0.0004 | 22 | 1.875 | 1.901 | 0.665 | Inventive example |
| 5D | 0.0008 | 36 | 1.875 | 1.921 | 0.632 | Inventive example |
| 5E | 0.004 | 40 | 1.875 | 1.930 | 0.605 | Inventive example |
| 5F | 0.016 | 46 | 1.875 | 1.931 | 0.592 | Inventive example |
| 5G | 0.051 | 69 | 1.875 | 1.942 | 0.580 | Inventive example |
| 5H | 0 | 18 | 1.885 | 1.901 | 0.739 | Comparative example |
| 5I | 0.004 | 35 | 1.871 | 1.903 | 0.614 | Inventive example |
| 5J | 0.030 | 49 | 1.871 | 1.899 | 0.621 | Inventive example |
| 5K | 0.037 | 66 | 1.871 | 1.914 | 0.598 | Inventive example |
| 5L | 0.100 | 105 | 1.871 | 1.954 | 0.672 | Inventive example |
| 5M | 0.009 | 47 | 1.885 | 1.911 | 0.726 | Comparative example |
| 5N | 0.017 | 52 | 1.878 | 1.926 | 0.622 | Inventive example |
| 5O | 0.028 | 44 | 1.878 | 1.912 | 0.631 | Inventive example |
| 5P | 0.020 | 41 | 1.878 | 1.909 | 0.642 | Inventive example |
| 5Q | 0.036 | 60 | 1.868 | 1.924 | 0.577 | Inventive example |
| 5R | 0 | 10 | 1.877 | 1.900 | 0.654 | Inventive example |
| 5S | 0.0007 | 34 | 1.877 | 1.918 | 0.633 | Inventive example |
| 5T | 0.010 | 48 | 1.877 | 1.931 | 0.602 | Inventive example |
| 5U | 0.002 | 37 | 1.877 | 1.926 | 0.618 | Inventive example |
| 5V | 0.018 | 51 | 1.877 | 1.931 | 0.609 | Inventive example |
| 5W | 0 | 11 | 1.877 | 1.880 | 0.685 | Inventive example |
| 5X | 0.010 | 48 | 1.877 | 1.901 | 0.674 | Inventive example |

TABLE 7

| | Composition of product (Metal part) (mass · ppm) | | | | | | |
|---|---|---|---|---|---|---|---|
| Symbol | C | P | S | Al | Se | N | B |
| 5A | 9 | <4 | <4 | 2 | <1 | 5 | <1 |
| 5B | 9 | <4 | <4 | 2 | <1 | 6 | <1 |
| 5C | 10 | <4 | <4 | 2 | <1 | 5 | <1 |
| 5D | 10 | <4 | <4 | 3 | <1 | 5 | <1 |
| 5E | 11 | <4 | <4 | 3 | <1 | 4 | <1 |
| 5F | 11 | <4 | <4 | 3 | <1 | 5 | <1 |
| 5G | 11 | <4 | <4 | 3 | <1 | 4 | <1 |
| 5H | 11 | <4 | <4 | 3 | <1 | 4 | <1 |
| 5I | 13 | <4 | <4 | 4 | <1 | 3 | <1 |
| 5J | 13 | <4 | <4 | 4 | <1 | 4 | <1 |
| 5K | 12 | <4 | <4 | 5 | <1 | 4 | <1 |
| 5L | 13 | <4 | <4 | 4 | <1 | 5 | <1 |
| 5M | 8 | <4 | <4 | 4 | <1 | 4 | 5 |
| 5N | 9 | <4 | <4 | 5 | <1 | 4 | 22 |
| 5O | 10 | <4 | <4 | 5 | <1 | 5 | 10 |
| 5P | 10 | <4 | <4 | 4 | <1 | 5 | 21 |
| 5Q | 13 | <4 | <4 | 4 | <1 | 4 | 15 |
| 5R | 15 | <4 | <4 | 5 | <1 | 3 | 9 |
| 5S | 16 | <4 | <4 | 4 | <1 | 4 | 7 |
| 5T | 15 | <4 | <4 | 5 | <1 | 4 | 8 |
| 5U | 16 | <4 | <4 | 4 | <1 | 5 | 12 |
| 5V | 17 | <4 | <4 | 3 | <1 | 2 | 8 |
| 5W | 15 | <4 | <4 | 5 | <1 | 3 | 9 |
| 5X | 15 | <4 | <4 | 5 | <1 | 4 | 8 |

As seen from the results of Table 6, by producing steel sheets according to the method of the invention, products having very low iron loss of $W_{17/50} \leqq 0.70$ W/kg are obtained. Above all, particularly when the sizes of secondary recrystallized grains have a mean length of not less than about 30 mm in the rolling direction, products having even lower iron loss of $W_{17/50}$ ranging from 0.56 to 0.68 W/kg are obtained. The secondary recrystallized grains having a mean length of not less than about 30 mm in the rolling direction are obtained by setting the Bi content in the steel slab to be not less than 0.001 mass % and setting the Bi content in the metal part of the product to be not less than 0.0005 mass %.

Example 4

Steel slabs were prepared which contained C: 0.06 mass %, Si: 3.3 mass %, Mn: 0.08 mass %, P: 0.001 mass %, S: 0.001 mass %, Al: 0.020 mass %, Se: 0.012 mass %, Sn: 0.07 mass %, Cu: 0.15 mass %, N: 0.0085 mass %, and Cr and Bi, respectively, in the range of 0 to 0.4 mass % and the range of 0 to 0.05 mass %, as shown in Table 8 below, the balance being primarily iron. Each steel slab was loaded in a gas heating furnace and heated to 1230° C. After holding the slab to stand in that condition for 60 minutes, the slab was further heated to 1400° C. for 30 minutes by induction heating, and then subjected to hot rolling to obtain a hot rolled sheet having a thickness of 2.4 mm. Thereafter, the hot rolled sheet was subjected to annealing of 900° C.×1 minute. After pickling the annealed sheet, a steel sheet having a thickness of 1.5 mm was obtained by primary cold rolling. The cold rolled sheet was then subjected to intermediate annealing (annealing before final cold rolling) at each soaking temperature (° C.), shown in Table 8 below, for 1 minute. After pickling, the steel sheet was subjected to secondary cold rolling at a maximum attainment temperature of 230° C. to obtain a final sheet thickness of 0.23 mm.

The steel sheet was then subjected to decarburization annealing of 850° C.×100 seconds. Subsequently, the steel sheet was coiled into the form of a coil after coating with an annealing separator, which contained MgO as a main ingredient and $TiO_2$: 5 mass %, in amount of 6 g/m$^2$ for each surface of the steel sheet. Thereafter, the steel sheet was subjected to final finishing annealing by raising the temperature from 700 to 1150° C. at a constant rate of 15° C./h and holding the sheet at 1200° C. for 10 hours. After removing the not-yet-reacted annealing separator by water washing, linear grooves each having a depth of 12 $\mu$m and a width of 50 μm were formed in the steel sheet using a gear-shaped roll at an array interval of 4 mm, the grooves extending at an angle of 10° relative to the C-direction. Subsequently, an insulation coating was formed by applying an insulation tensile coating agent, which contained as a main ingredient magnesium phosphate and colloidal silica, in an amount of 5 g/m$^2$ for each surface of the steel sheet. Flattening annealing was performed, whereby a product was obtained. Tension imparted from the coatings to the metal part of the products were in the range of 4.5 to 5.5 MPa. Additionally, each obtained product had metal part composition of C: 0.0010 mass %, P: 0.0005 mass %, S:<0.0004 mass %, Al: 0.0004 mass %, Se:<0.0001 mass %, and N: 0.0004 mass %. Further, in the steel sheet resulting from the steel slab in which 0.02 mass % of Bi was added, the Bi content in metal part was about 0.015 mass %, and in the steel sheet resulting from the steel slab in which 0.05 mass % of Bi was added, the Bi content in metal part was about 0.04 mass %. The contents of other ingredients in the metal part were the same as those in the slab.

An Epstein test piece of about 500 g was sampled from each product obtained by the above-described process, and iron loss $W_{17/50}$ and magnetic flux density $B_8$ of the test piece were measured in accordance with the Epstein test procedure.

TABLE 8

| Symbol | Intermediate annealing temperature (° C.) | Slab composition (mass %) Cr | Bi | $B_8$ (T) | $W_{17/50}$ (W/kg) | Remarks |
|---|---|---|---|---|---|---|
| 7A | 1100 | 0 | 0 | 1.908 | 0.764 | Comparative example |
| 7B | 1100 | 0 | 0.02 | 1.935 | 0.711 | Comparative example |
| 7C | 1100 | 0 | 0.05 | 1.942 | 0.696 | Comparative example |
| 7D | 1060 | 0.2 | 0 | 1.906 | 0.666 | Inventive example |
| 7E | 1060 | 0.2 | 0.02 | 1.932 | 0.611 | Inventive example |
| 7F | 1060 | 0.2 | 0.05 | 1.937 | 0.598 | Inventive example |
| 7G | 1020 | 0.4 | 0 | 1.899 | 0.658 | Inventive example |
| 7H | 1020 | 0.4 | 0.02 | 1.926 | 0.612 | Inventive example |
| 7I | 1020 | 0.4 | 0.05 | 1.934 | 0.589 | Inventive example |

As seen from the results of Table 8, by producing steel sheets according to the method of the invention, products having very low iron loss of $W_{17/50} \leqq 0.67$ W/kg are obtained. Particularly, when Bi is contained in the slab composition, products having more superior characteristics, i.e., even lower iron loss of $W_{17/50} \leqq 0.62$ W/kg, are obtained.

Example 5

Steel slabs were prepared which contained C: 0.07 mass %, Si: 3.30 mass %, Mn: 0.15 mass %, P: 0.003 mass %, S: 0.016 mass %, Al: 0.025 mass %, Cr: 0.3 mass %, Sn: 0.05 mass %, Cu: 0.15 mass %, N: 0.0035 mass %, and Bi: 0.015 mass %, the balance being primarily iron. Each steel slab was heated to 1150° C. for 90 minutes, and then subjected to hot rolling to obtain a hot rolled sheet having a thickness of 2.0 mm. Thereafter, the hot rolled sheet was subjected to annealing at a temperature of 900° C. for 1 minute. After pickling the annealed sheet, a steel sheet having a thickness of 1.2 mm was obtained by primary cold rolling. The cold rolled sheet was then subjected to intermediate annealing (annealing before final cold rolling) at each soaking temperature in the range of 900 to 1150° C., shown in Table 9 below, for 1 minute. After pickling, the steel sheet was subjected to secondary cold rolling at a maximum attainment temperature of 250° C. to obtain a final sheet thickness of 0.23 mm.

The steel sheet was then subjected to decarburization annealing, and subsequently to nitriding annealing in an atmosphere of $NH_3$ so that the N content of 0.020 mass % was obtained. After coating with an annealing separator, in which 10 weight parts of $TiO_2$ was added to 100 weight parts of MgO, in an amount of 6.5 g/m$^2$ for each surface of the steel sheet, the steel sheet was subjected to final finishing annealing at 1150 to 1200° C. for 15 hours of residing time. Then, an insulation coating was formed by applying an insulation tensile coating agent, which contained as a main ingredient magnesium phosphate and colloidal silica, in an amount of 5 g/m$^2$ for each surface of the steel sheet. After flattening annealing, domain refining treatment was performed on the steel sheet by laser irradiation at each of intervals ranging from 3 to 15 mm, shown in Table 9, whereby a product was obtained. Tension imparted from the coatings to the metal part of the products were in the range of 4.5 to 5.5 MPa. Additionally, each obtained product had a metal part composition of C: 0.0011 mass %, P:<0.0004 mass %, S: 0.0005 mass %, Al: 0.0005 mass %, N:<0.0006 mass %, and Bi: 0.011 mass %. The contents of other ingredients in the metal part were the same as those in the slab.

An Epstein test piece of about 500 g was sampled from each product obtained by the above-described process, and iron loss $W_{17/50}$ of the test piece was measured in accordance with the Epstein test procedure.

TABLE 9

| No. | Intermediate annealing temperature (° C.) | $W_{17/50}$ (W/kg) Laser irradiation interval 3 mm | 5 mm | 8 mm | 15 mm |
|---|---|---|---|---|---|
| 1 | 900 | 0.799 | 0.732 | 0.735 | 0.784 |
| 2 | 1000 | 0.702 | 0.649 | 0.621 | 0.712 |
| 3 | 1060 | 0.714 | 0.632 | 0.603 | 0.724 |
| 4 | 1150 | 0.854 | 0.832 | 0.824 | 0.865 |

As seen from the results of Table 9, products having very low iron loss of $W_{17/50} \leqq 0.65$ W/kg are obtained under the conditions according to the invention.

Example 6

Steel slabs were prepared which contained C: 0.07 mass %, Si: 3.0 mass %, Mn: 0.08 mass %, P: 0.002 mass %, S: 0.0013 mass %, Al: 0.022 mass %, N: 0.0090 mass %, Cu:

0.05 mass %, Sn: 0.04 mass %, Bi: 0.007 mass %, and (A) Cr: 0.3 mass % or (B) Cr: 0.01 mass %, the balance being primarily iron. Each steel slab was loaded in a gas heating furnace and heated to 1250° C. After holding the slab to stand in that condition for 60 minutes, the slab was further heated to 1400° C. for 30 minutes by induction heating, and then subjected to hot rolling to obtain a hot rolled sheet having a thickness of 2.0 mm. Thereafter, the hot rolled sheet was subjected to annealing of 1050° C.×60 seconds (annealing before final cold rolling). After pickling the annealed sheet, the steel sheet was subjected to cold rolling at a maximum attainment temperature of 120° C. to obtain a final sheet thickness of 0.27 mm. The steel sheet was then subjected to decarburization annealing of 850° C.×100 seconds. Subsequently, the steel sheet was coiled into the form of a coil after coating with an annealing separator, which contained MgO as a main ingredient and $TiO_2$: 4 mass %, in amount of 7 g/m$^2$ for each surface of the steel sheet. Thereafter, the steel sheet was subjected to final finishing annealing by holding the sheet to stand at 1200° C. for 5 hours. After removing the not-yet-reacted annealing separator by water washing, an insulation tensile coating agent, which contained as a main ingredient magnesium phosphate, was applied and baked in amount of 4 g/m$^2$ or 1.5 g/m$^2$ for each surface of the steel sheet, followed by flattening annealing. Then, a laser beam was irradiated to the steel sheet at a pitch of 9.0 mm and at an angle of 15° relative to the C-direction, whereby a product was obtained. An Epstein test piece of about 500 g was sampled from each product obtained by the above-described process, and iron loss $W_{17/50}$ and magnetic flux density $B_8$ of the test piece were measured in accordance with the Epstein test procedure. Tension imparted from the coatings to the metal part of the products were in the range of 4.5 to 5.5 MPa. Additionally, each obtained product had metal part composition of C: 0.0013 mass %, P:<0.0004 mass %, S: 0.0005 mass %, Al: 0.0004 mass %, N: 0.0003 mass %, and Bi: 0.001 mass %. The contents of other ingredients in the metal part were the same as those in the slab.

Obtained results are listed in Table 10 below.

TABLE 10

| No. | Cr (mass %) | Amount of insulation tensile coating (g/cm$^2$) | Coating tension (MPa) | $W_{17/50}$ (W/kg) | $B_8$ (T) | Remarks |
|---|---|---|---|---|---|---|
| 1 | 0.3 | 4 | 4.2 | 0.71 | 1.965 | Inventive example |
| 2 | 0.3 | 1.5 | 2.1 | 0.80 | 1.965 | Comparative example |
| 3 | 0.01 | 4 | 4.1 | 0.81 | 1.975 | Comparative example |
| 4 | 0.01 | 1.5 | 1.9 | 0.90 | 1.975 | Comparative example |

As seen from the results of Table 10, by producing steel sheets according to the method of the invention, products having very low iron loss of $W_{17/50} \leqq 0.75$ W/kg were obtained in spite of having a thickness of 0.27 mm.

According to the invention, as described above, iron loss of a grain oriented electrical steel sheet subjected to domain refining can effectively be reduced. Therefore, the invention contributes to reducing energy loss caused with power transmission and distribution when the grain oriented electrical steel sheet is employed as core materials of transformers and so on.

What is claimed is:

1. A grain oriented electrical steel sheet with low iron loss, comprising:

a metal part comprising Si: about 2.5 to about 5.0 mass % and Cr: about 0.05 to about 1.0 mass %, an insulation coating formed on a surface of the metal part and made of one or more layers, and a plurality of induced linear strains at the surface of said steel sheet, including the metal part, which linearly extend at an angle not larger than about 45° relative to the direction perpendicular to the rolling direction, wherein magnetic flux density $B_8$ (T) satisfies formula (1) and an array interval D (mm) of said linear strains satisfies formula (2):

$$B_8 \geqq (2.21-0.0604(\mathrm{Si})-0.0294(\mathrm{Cr}))\times 0.960 \quad (1)$$

$$3+5(\mathrm{Cr}) \leqq D \leqq 11+5(\mathrm{Cr}) \quad (2), \text{ and}$$

wherein (Si) and (Cr) represent mass percentages of Si and Cr in the metal part.

2. The grain oriented electrical steel sheet according to claim 1, wherein a tension of not smaller than 3.0 MPa is imparted to the metal part in the rolling direction by said insulation coating.

3. The grain oriented electrical steel sheet according to claim 1, wherein, of the layers making up said insulation coating, the layer in contact with the metal part is made of forsterite as a main ingredient.

4. The grain oriented electrical steel sheet according to claim 1, wherein the mean length of secondary recrystallized grains in the rolling direction is not less than about 30 mm.

5. The grain oriented electrical steel sheet according to claim 1, wherein the metal part further contains Bi: about 0.0005 to about 0.08 mass %.

6. A grain oriented electrical steel sheet with low iron loss, comprising:

a metal part containing Si: about 2.5 to about 5.0 mass % and Cr: about 0.2 to about 0.7 mass %, an insulation coating formed on a surface of the metal part and made of one or more layers, and a plurality of grooves formed in the surface of the metal part which linearly extend at an angle of not larger than about 45° relative to the direction perpendicular to the rolling direction, wherein magnetic flux density $B_8$ satisfies formula (3) and an array interval D (mm) of said grooves satisfies formula (4):

$$B_8 \geqq (2.21-0.0604(\mathrm{Si})-0.0294(\mathrm{Cr}))\times 0.960-0.0030d \quad (3)$$

$$1+5(\mathrm{Cr}) \leqq D \leqq [8]5+5(\mathrm{Cr}) \quad (4), \text{ and}$$

wherein (Si) and (Cr) represent mass percentages of Si and Cr in the metal part and wherein $B_8$ is measured in T, d is a depth of the grooves measured in $\mu$m, and D is measured in mm.

7. The grain oriented electrical steel sheet according to claim 6, wherein depth (d) of each of said grooves is in the range of about 1.5 to about 15% of metal part thickness.

8. The grain oriented electrical steel sheet according to claim 6, wherein a tension of not smaller than 3.0 MPa is imparted to the metal part in the rolling direction by said insulation coating.

9. The grain oriented electrical steel sheet according to claim 6, wherein, of the layers making up said insulation coating, the layer in contact with the metal part is made of forsterite as a main ingredient.

10. The grain oriented electrical steel sheet according to claim 6, wherein the mean length of secondary recrystallized grains in the rolling direction is not less than about 30 mm.

11. The grain oriented electrical steel sheet according to claim 6, wherein the metal part further contains Bi: about 0.0005 to about 0.08 mass %.

12. The grain oriented electrical steel sheet according to claim 1, wherein Cr content is about 0.2 to about 0.7 mass %, and wherein the array interval D (mm) of said linear strains satisfies formula (5):

$$5+5(\mathrm{Cr}) \leqq D \leqq 9+5(\mathrm{Cr}) \quad (5).$$

13. A grain oriented electrical steel sheet with low iron loss, comprising:

a metal part containing Si: about 2.5 to about 5.0 mass %. Cr: about 0.05 to about 1.0 mass %, and Bi: about 0.0005 to about 0.08 mass %, an insulation coating formed on a surface of the metal part and made of one or more layers, and a plurality of grooves formed in the surface of the metal part which linearly extend at an angle of not larger than about 45° relative to the direction perpendicular to the rolling direction, wherein magnetic flux density $B_8$ satisfies formula (3) and an array interval D (mm) of said grooves satisfies formula (4):

$$B_{8\geqq}(2.21-0.0604(\mathrm{Si})-0.0294(\mathrm{Cr}))\times 0.960-0.0030d \quad (3)$$

$$1+5(\mathrm{Cr}) \leqq D \leqq [8]5+5(\mathrm{Cr}) \quad (4), \text{ and}$$

wherein (Si) and (Cr) represent mass percentages of Si and Cr in the metal part and wherein $B_8$ is measured in T, d is a depth of the grooves measured in $\mu$m, and D is measured in mm.

* * * * *

UNITED STATES PATENT AND TRADEMARK OFFICE

CERTIFICATE OF CORRECTION

PATENT NO. : 6,602,357 B2
DATED : August 5, 2003
INVENTOR(S) : Senda et al.

It is certified that error appears in the above-identified patent and that said Letters Patent is hereby corrected as shown below:

Column 10,
Line 27, please change "1+S" to -- 1+5 --.

Column 34,
Line 52, please change formula 4 from "$1+5(Cr) \leq D \leq [8]5+5(Cr)$" to -- $1+5(Cr) \leq D \leq 5+5(Cr)$ --.

Column 36,
Line 12, please change formula 4 from "$1+5(Cr) \leq D \leq [8]5+5(Cr)$" to -- $1+5(Cr) \leq D \leq 8+5(Cr)$ --.

Signed and Sealed this

Sixth Day of July, 2004

JON W. DUDAS
*Acting Director of the United States Patent and Trademark Office*